US008141304B2

(12) United States Patent
Shen et al.

(10) Patent No.: US 8,141,304 B2
(45) Date of Patent: Mar. 27, 2012

(54) PREFABRICATED CONTAINER HOUSE

(75) Inventors: Kangna Nelson Shen, Tokyo (JP); Coen Germeraad, Meppel (NL)

(73) Assignee: Kangna Nelson Shen, Tokyo (JP)

( * ) Notice: Subject to any disclaimer, the term of this patent is extended or adjusted under 35 U.S.C. 154(b) by 219 days.

(21) Appl. No.: 12/385,516

(22) Filed: Apr. 9, 2009

(65) Prior Publication Data

US 2010/0192481 A1 Aug. 5, 2010

(30) Foreign Application Priority Data

Feb. 5, 2009 (JP) ..... 2009-025413

(51) Int. Cl.
*E04B 1/343* (2006.01)
*E04H 1/02* (2006.01)
*E04G 21/14* (2006.01)

(52) U.S. Cl. ..... 52/79.5; 52/745.2; 52/645; 52/68; 52/72; 52/270; 296/24.33; 296/26.02; 296/26.08; 296/172; 296/175

(58) Field of Classification Search ..... 52/79.1–79.14, 52/64–72, 302.1, 220.1–220.6, 646, 302.5, 52/302.6, 268–270, 406.1, 747.1, 636–637, 52/634, 641, 745.01, 745.02, 745.16, 173.1, 52/143; 296/26.01–26.15, 24.3, 24.33, 24.38, 296/156, 159, 160, 162, 165, 168, 181, 172, 296/175–176, 182.1, 183.1, 164, 171; 220/1.5, 220/4.03; 280/6.153, 7.1
See application file for complete search history.

(56) References Cited

U.S. PATENT DOCUMENTS

| | | | | |
|---|---|---|---|---|
| 3,835,600 | A * | 9/1974 | Padula et al. | 52/67 |
| 4,660,332 | A * | 4/1987 | Colvin, Jr. | 52/79.5 |
| 4,841,897 | A * | 6/1989 | Claflin | 114/344 |
| 5,345,730 | A | 9/1994 | Jurgensen | |
| 5,706,615 | A * | 1/1998 | Bridges et al. | 52/105 |
| 5,765,316 | A | 6/1998 | Kavarsky | |
| 5,984,587 | A | 11/1999 | Odle | |
| 6,712,414 | B2 * | 3/2004 | Morrow | 296/26.01 |
| 6,772,563 | B2 * | 8/2004 | Kuhn | 52/67 |

(Continued)

FOREIGN PATENT DOCUMENTS

JP 2001-115559 4/2001

(Continued)

OTHER PUBLICATIONS

Notification of Transmittal of the International Search Report and the Written Opinion of the International Searching Authority (Form PCT/ISA/200); International Search Report (Form PCT/ISA/210); and Written Opinion of the International Searching Authority (Form PCT/ISA/237), mailed Jan. 8, 2010, of related International Application No. PCT/US2009/005859.

(Continued)

*Primary Examiner* — Jeanette E. Chapman
(74) *Attorney, Agent, or Firm* — The Nath Law Group; Jerald L. Meyer; Jiaxiao Zhang

(57) ABSTRACT

A prefabricated container house includes a container type main frame member when on a chassis capable of being pulled by a trailer truck; and dwelling forming members which can be housed in the main frame member, and which can be drawn out of the main frame member at an installation site, and assembled into a house.

14 Claims, 21 Drawing Sheets

U.S. PATENT DOCUMENTS

| | | | | |
|---|---|---|---|---|
| 6,957,930 | B2 | 10/2005 | Landau | |
| 6,983,567 | B2 | 1/2006 | Ciotti | |
| 7,240,945 | B1 * | 7/2007 | Crean | 296/37.7 |
| 7,290,372 | B2 * | 11/2007 | Aust et al. | 52/67 |
| 7,418,802 | B2 * | 9/2008 | Sarine et al. | 52/79.5 |
| 7,631,460 | B2 * | 12/2009 | Napier | 52/69 |
| 7,784,845 | B2 * | 8/2010 | Kim et al. | 296/26.01 |
| 7,828,367 | B2 * | 11/2010 | Hickam et al. | 296/156 |
| 7,882,659 | B2 * | 2/2011 | Gyory et al. | 52/79.5 |
| 2003/0051417 | A1 * | 3/2003 | Ciotti | 52/71 |
| 2006/0059792 | A1 * | 3/2006 | Tiramani | 52/79.1 |
| 2006/0225369 | A1 * | 10/2006 | Napier | 52/69 |
| 2007/0170740 | A1 | 7/2007 | Di Franco | |
| 2007/0271857 | A1 * | 11/2007 | Heather et al. | 52/79.9 |
| 2008/0134589 | A1 | 6/2008 | Abrams et al. | |
| 2008/0141596 | A1 * | 6/2008 | Kelly et al. | 52/23 |
| 2009/0217600 | A1 * | 9/2009 | De Azambuja | 52/79.5 |
| 2010/0011676 | A1 * | 1/2010 | Barry | 52/79.5 |
| 2010/0024317 | A1 * | 2/2010 | Pope | 52/79.5 |
| 2010/0064599 | A1 * | 3/2010 | Yang et al. | 52/79.5 |

FOREIGN PATENT DOCUMENTS

| | | |
|---|---|---|
| JP | 2005-155012 | 6/2005 |
| JP | 2005-256534 | 9/2005 |
| JP | 3127532 | 12/2006 |

OTHER PUBLICATIONS

Notification of Transmittal of the International Search Report and the Written Opinion of the International Searching Authority (Form PCT/ISA/200); International Search Report (Form PCT/ISA/210); and Written Opinion of the International Searching Authority (Form PCT/ISA/237), mailed Nov. 26, 2010, of related International Application No. PCT/US2010/042700.

* cited by examiner

PREFABRICATED CONTAINER HOUSE

CROSS REFERENCE TO RELATED APPLICATION

This application is based upon and claims the benefit of priority from the prior Japanese Patent Application No. 2009-25413, filed on Feb. 5, 2009, the entire contents of which are incorporated herein by reference.

BACKGROUND OF THE INVENTION

1. Field of the Invention

The present invention relates to a prefabricated container house which when put on a chassis can be pulled by a trailer truck and which is transportable/movable to an installation site. The house can also be lifted on and lifted off a container ship with the use of appropriate equipment such as a crane.

2. Description of the Related Art

A prefabricated house for a provisional house or the like is proposed in Japanese Patent Application Publication No. 2005-155012 as a dwelling which can be assembled. Such a prefabricated house is built in the following manner. Specifically, housing frame members such as floor members and roof members, and partitioning members such as wall members are transported to a construction site (an installation site). Then, these members are assembled on a foundation constructed at the construction site in advance by specialized workers (carpenters). Therefore, it takes time to disassemble such a prefabricated house once built. Thus, the prefabricated house is not easy to move from the construction site.

Meanwhile, a trailer house used as a dwelling which can be moved to any installation site is proposed in Japanese Utility Model Registration No. 3127532. Such a trailer house has already been assembled with a predetermined room arrangement, and is pulled and moved to an installation site, using a trailer truck or the like. At the destination, the trailer house can be used as a dwelling in which people live a life.

However, the above-described prefabricated house is inconvenient, because the prefabricated house is fastened at the construction site and cannot be moved. Further, to extend the dwelling, a number of members need to be assembled in addition to members which have already been assembled. Therefore, extension work is cumbersome.

Meanwhile, a trailer house is movable, and in addition, does not need to be assembled at a destination. However, since the trailer house has already been assembled into a house, the trailer house is limited to a size which can be moved, so that it is not possible to have a more spacious house. In addition, since the house cannot be extend, there is some inconvenience associated with a limited living space.

SUMMARY OF THE INVENTION

An object of the present invention is to provide a prefabricated container house which can be moved to any place, which enables the amount of cumbersome assembly work to be minimalized and which enables living space to be extended nearly threefold based on a single unit.

A first aspect of the invention is to provide a prefabricated container house comprising: a main body transportable/movable to an installation site; and a house forming body configured to be housed in the main body, transported/moved to the installation site along with the main body, and drawn out of the main body at the installation site so as to be expanded/assembled.

Here, the main body may include a container-shaped main frame member capable of being pulled by a trailer truck, and the house forming body may include a plurality of dwelling forming members which are housed in the main frame member, and which are drawn out of the main frame member at the installation site and assembled into a house.

Here, the main frame member may be formed into a box shape with a pair of upper and lower horizontal frames forming a floor and a ceiling, respectively, and with a pair of vertical frames each connecting the horizontal frames at the ends of the horizontal frames to form a wall, the dwelling forming members may include a floorboard, a ceiling board, wall panels, a bath/toilet unit, and a kitchen unit, and the main frame member may house a sub-frame member including: a floor supporting frame supporting the floorboard which is drawn out of the main frame member and assembled at the installation site; and a ceiling supporting frame supporting the ceiling board which is drawn out of the main frame member and assembled at the installation site.

Here, the sub-frame member may include a plurality of reinforcing columns provided between the pair of horizontal frames so as to reinforce the main frame member.

Here, the floor supporting frame and the ceiling supporting frame may be drawn outward from the horizontal frames.

Here, two or more of the house bodies may be stacked to form a multi-story dwelling.

Here, the floorboard and the ceiling board may be overlapped and housed between the pair of horizontal frames, some of the wall panels may be overlapped with the corresponding one of the vertical frames and housed, and the rest of the wall panels may be overlapped and housed at an intermediate position between the vertical frames.

A second aspect of the invention is to provide a container house comprising: a main frame member having a box shape, including a pair of vertical frames having a rectangular plate shape, upper and lower horizontal frames each having a rectangular plate shape connected to the pair of vertical frames, and an opening on at least one of sides of the main frame member; a movable floorboard configured to horizontally extend from a lower portion of the main frame member outward of the main frame member; a movable ceiling board configured to horizontally extend from an upper portion of the main frame member outward of the main frame member; and movable wall panels provided so as to be drawn out of one of the vertical frames between the movable floorboard and the movable ceiling board, with the movable floorboard and the movable ceiling board extended horizontally.

Here, the movable floorboard may be supported on the lower portion of the main frame member pivotally between a vertical position and a horizontal position about a horizontal axis, and the movable floorboard may function as a cover closing the opening of the main frame member in the horizontal position.

Here, the movable ceiling board may be supported on the upper portion of the main frame member pivotally about a horizontal axis.

Here, the movable wall panels may include outer wall panels each supported on an end of the movable wall panels pivotally about a vertical axis.

Here, the container house may further comprise a floor supporting frame protrudable under the movable floorboard from a lower portion of the main frame member so as to support the movable floorboard extended horizontally.

Here, the container house may further comprise a ceiling supporting frame protrudable over the movable ceiling board from an upper portion of the main frame member so as to support the movable ceiling board extended horizontally.

Here, the container house may further comprise a bed unit supported on a lower portion of the main frame member pivotally about a horizontal axis.

Here, the movable wall panels may be provided slidably on the movable floorboard.

Here, the movable ceiling board may be supported on the upper portion of the main frame member pivotally between a vertical position and a horizontal position about a horizontal axis, and the movable ceiling board may function as a cover closing the opening of the main frame member in the horizontal position.

A third aspect of the invention is to provide a A container house, comprising: a main frame member having a box shape, including a pair of vertical frames having a rectangular plate shape, upper and lower horizontal frames each having a rectangular plate shape connected to the pair of vertical frames, and an opening on at least one of sides of the main frame member; a movable floorboard configured to horizontally extend from a lower portion of the main frame member outward of the main frame member, the movable floorboard being supported on the lower portion of the main frame member pivotally between a vertical position and a horizontal position about a horizontal axis, and the movable floorboard functioning as a cover closing the opening of the main frame member in the horizontal position; a movable ceiling board configured to horizontally extend from an upper portion of the main frame member outward of the main frame member, the movable ceiling board being supported on the upper portion of the main frame member pivotally about a horizontal axis; movable wall panels provided so as to be drawn out of one of the vertical frames between the movable floorboard and the movable ceiling board, with the movable floorboard and the movable ceiling board extended horizontally, the movable wall panels being provided slidably on the movable floorboard, the movable wall panels including outer wall panels each supported on an end of the movable wall panels pivotally about a vertical axis; a floor supporting frame protrudable under the movable floorboard from a lower portion of the main frame member so as to support the movable floorboard extended horizontally; and a ceiling supporting frame protrudable over the movable ceiling board from an upper portion of the main frame member so as to support the movable ceiling board extended horizontally.

According to the above aspects and configurations, the prefabricated container house can be moved to any place in the following manner. Specifically, the main body is transported or moved to an installation site on a chassis, for example, by a trailer truck or the like. And in this connection the house can be lifted on and lifted off a container ship with use of appropriate equipment such as a crane. Thereafter, the house forming body housed in the main body is drawn, expanded, and assembled to form a house or place of business such as office, shop, health clinic, or hotel room.

The only thing to do at the installation site is to draw the house forming body from the main body, expand and assemble the house forming body, and cumbersome assembly work is reduced to minimal at the destination.

Further, the house main bodies are stacked, so that space can be extended by however many main house bodies are stacked one on top of the other.

DETAILED DESCRIPTION OF TEE EMBODIMENTS

Figure 1:
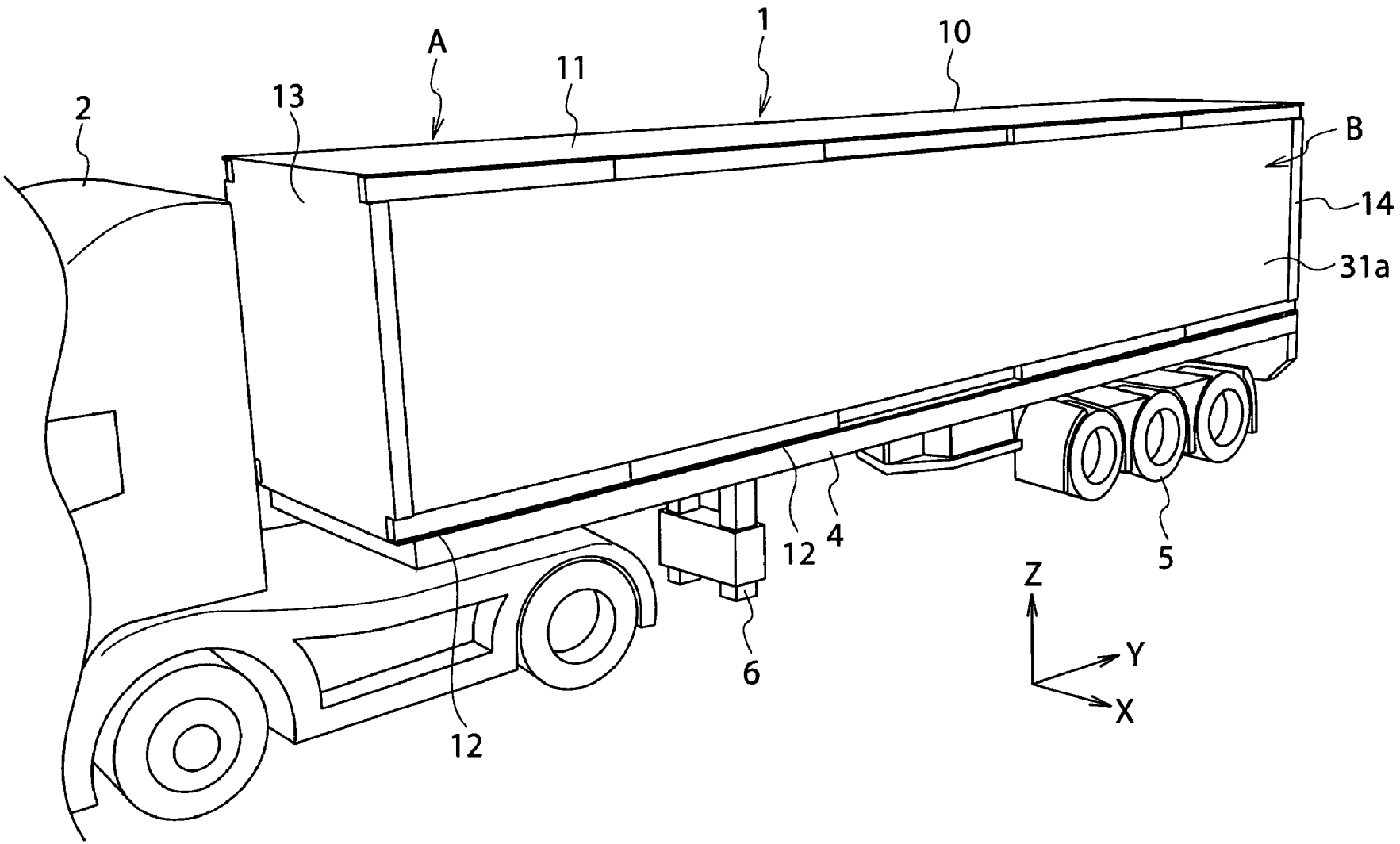
FIG. 1 is a perspective view of a movable prefabricated container house according to a first embodiment of the present invention, the movable container house being in a drawn state.
Figure 2:
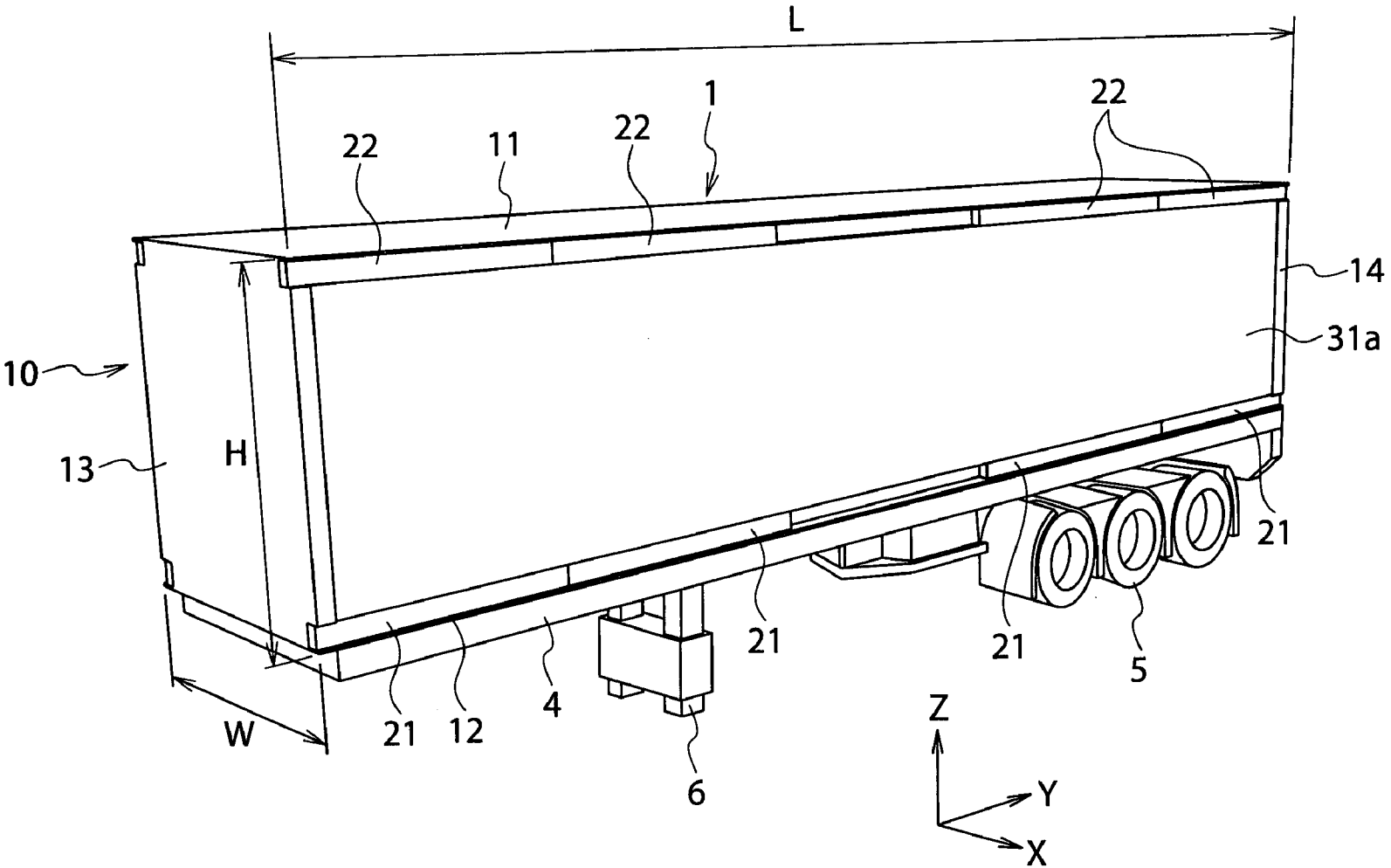
FIG. 2 is a perspective view of the movable prefabricated container house according to the first embodiment not in the drawn state.

FIGS. 1 and 2 each show a perspective view of an entire configuration of a movable prefabricated container house 1 according to a first embodiment of the present invention.

The movable prefabricated container house 1 of the present embodiment includes a main body A and a house forming body B. The main body A can be transported/moved to an installation site. The house forming body B is housed (held) in the main body, transported or moved to the installation site along with the main body A, and thereafter, drawn out of the main body A to be expanded and set up at the installation site.

As shown in FIG. 1, the movable prefabricated container house 1 is pulled by a trailer truck (semi-trailer truck) 2. To a rear part of the trailer truck 2, a chassis (wheeled platform) 4 is connected. On a lower part of a rear side of the chassis 4, a plurality of wheels 5 are mounted so that the chassis 4 can be pulled. On a lower part of a front side of the chassis 4, a supporting block 6 is mounted. A connection between the trailer truck 2 and the chassis 4 is made by connecting a coupler of the chassis 4 to a kingpin of the trailer truck 2. The movable prefabricated container house 1 is loaded on the chassis 4 and fastened thereto with a bolt or the like. Thus, the movable prefabricated container house 1 is ready to be pulled by the trailer truck 2. The movable prefabricated container house 1 can be the size of a 20 feet container, a 40 feet container or a 45 feet container. However, the size of the movable prefabricated container house 1 is not limited to these sizes.

At an installation site of destination, the chassis 4 is separated from the trailer truck 2. Therefore, the movable prefabricated container house 1 is supported and remains stationary on the chassis 4. Then, the movable prefabricated container house 1 supported on the chassis 4 or unloaded from the chassis 4 is expanded and assembled into a dwelling. Hereinafter, description will be given of an example in which the movable prefabricated container house 1 supported on the chassis 4 is expanded and assembled into a dwelling as in the former case. Here, the term "house" herein also includes a meaning of a place of business such as office, shop, health clinic, or hotel room. The term "dwelling" is used herein only for explaining this embodiment as an example. Thus, the movable prefabricated container house 1 may be expanded and assembled into a place of business such as office, shop, health clinic, or hotel room.

Figure 3:
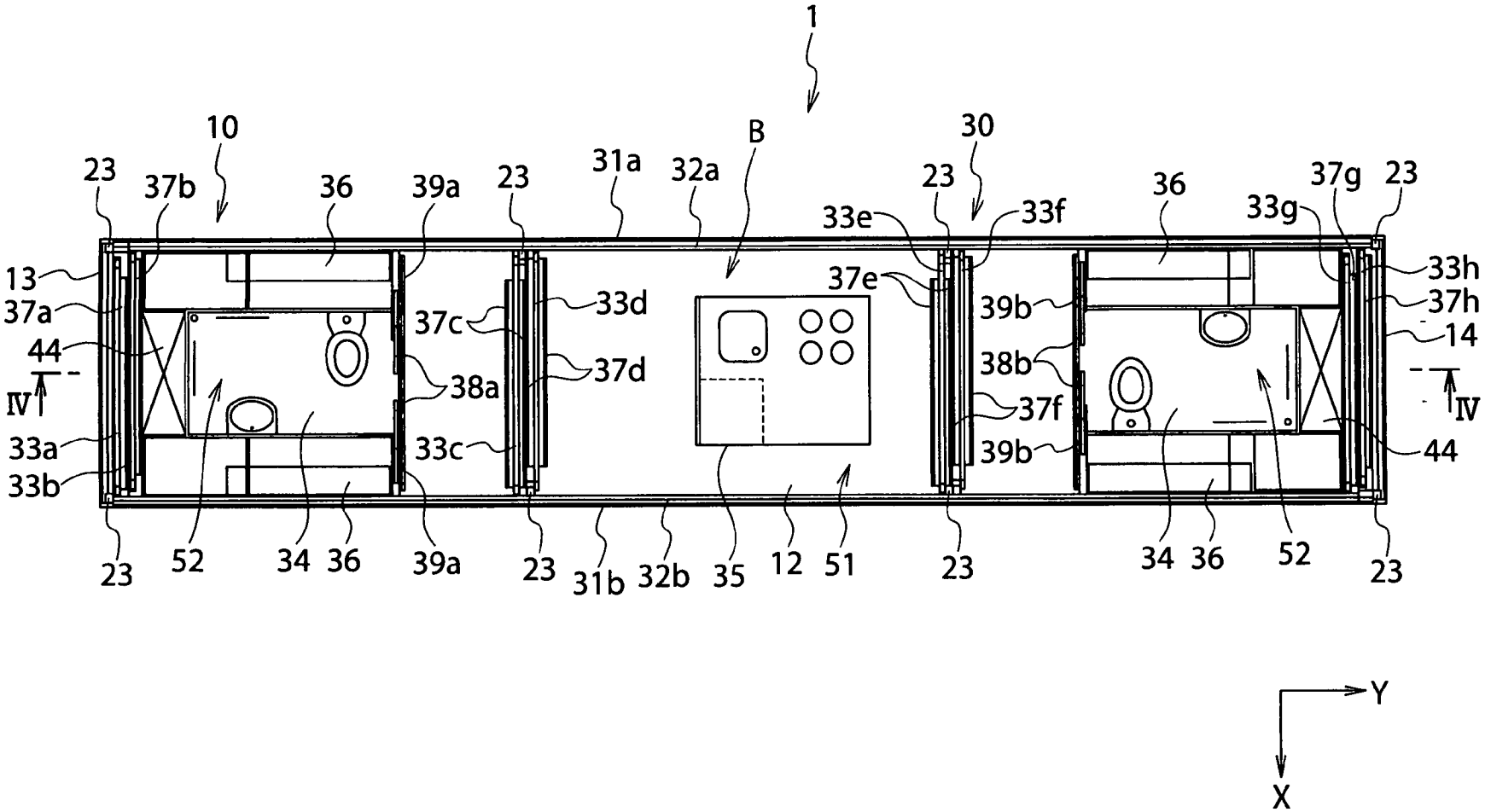
FIG. 3 is a horizontal sectional view of the movable prefabricated container house according to the first embodiment in a non-expanded state.
Figure 4:
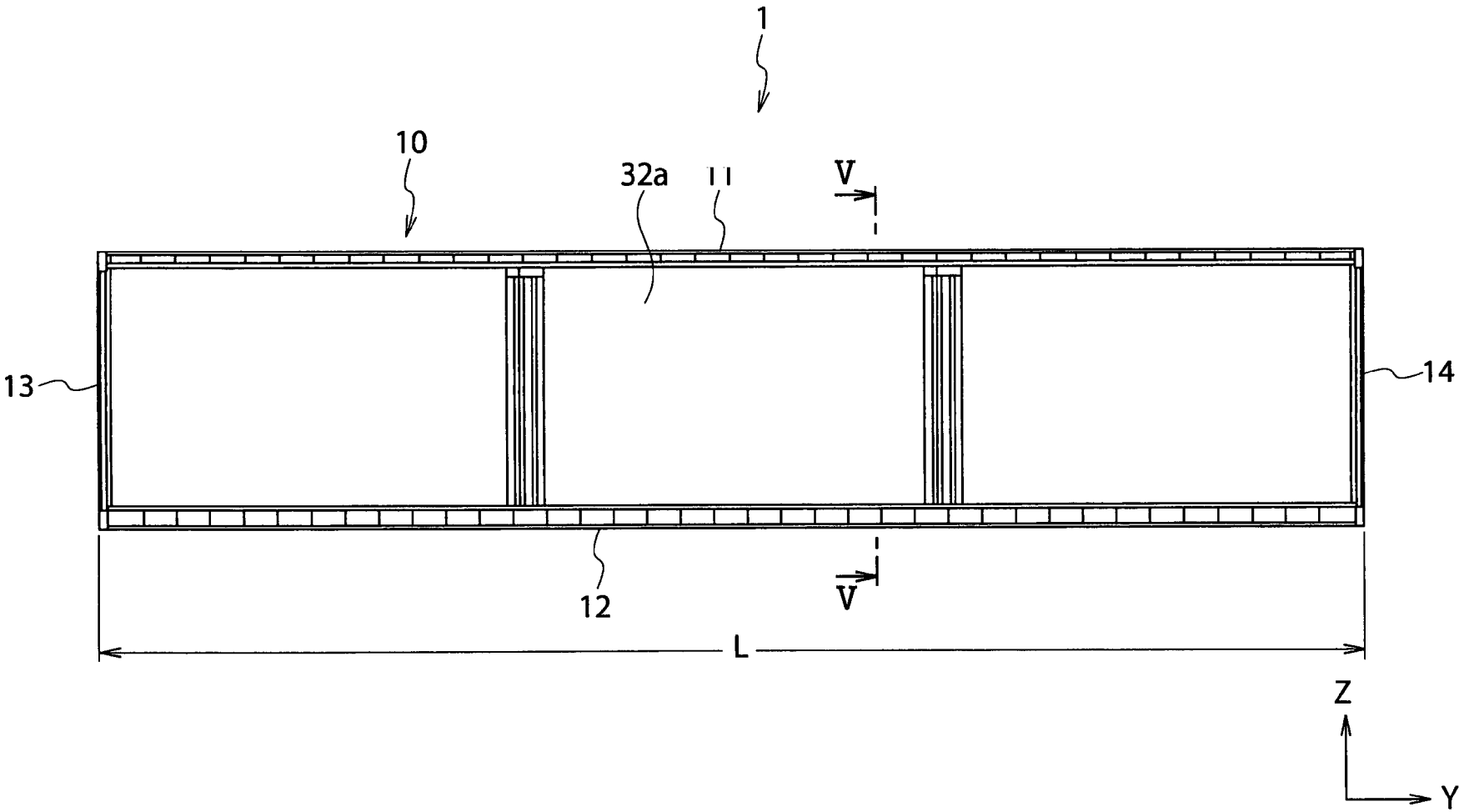
FIG. 4 is a sectional view taken along the direction indicated by arrows IV-IV of FIG. 3.
Figure 5:
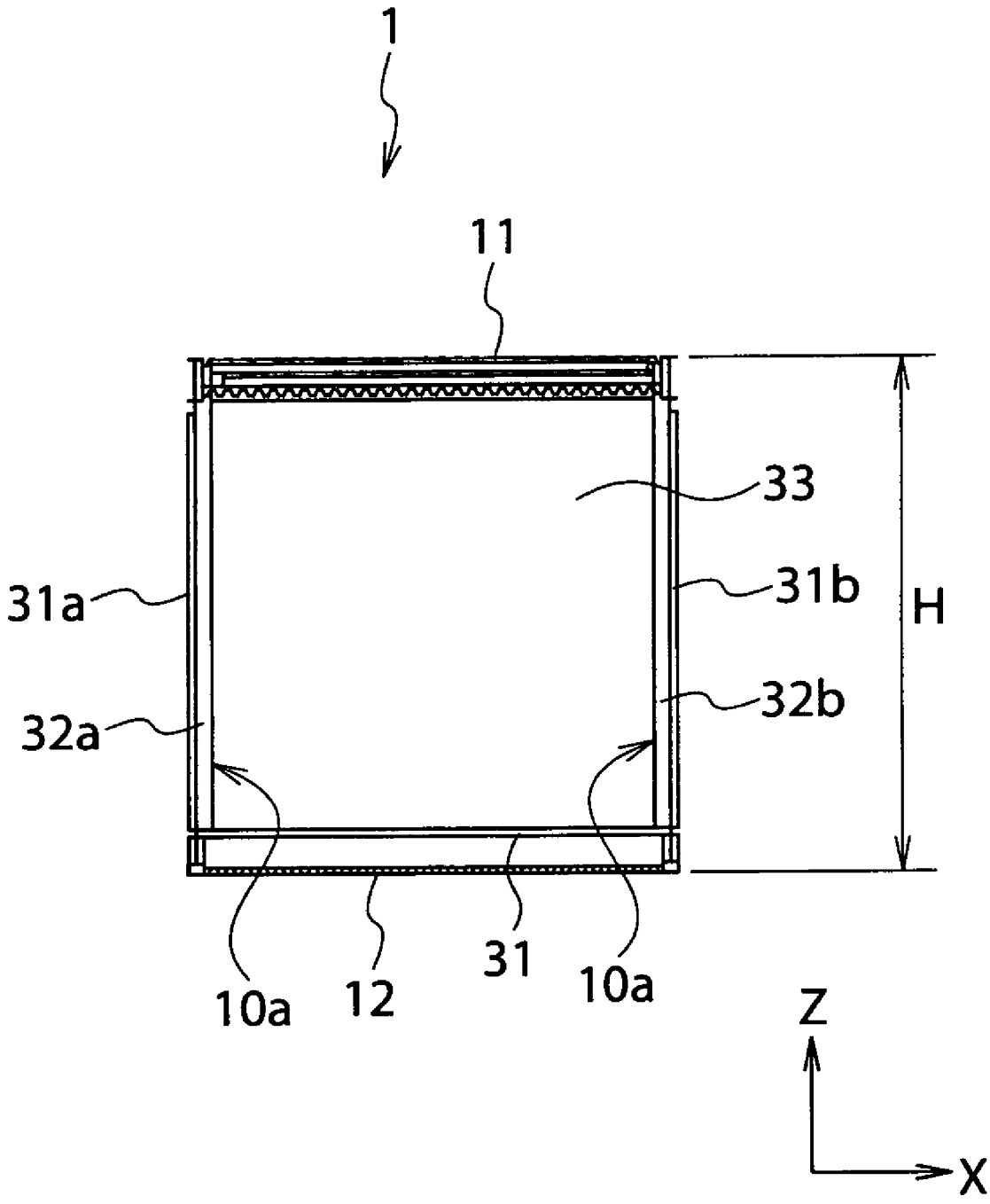
FIG. 5 is a sectional view taken along the direction indicated by arrows V-V of FIG. 4, of the movable prefabricated container house thereof.
Figure 6:
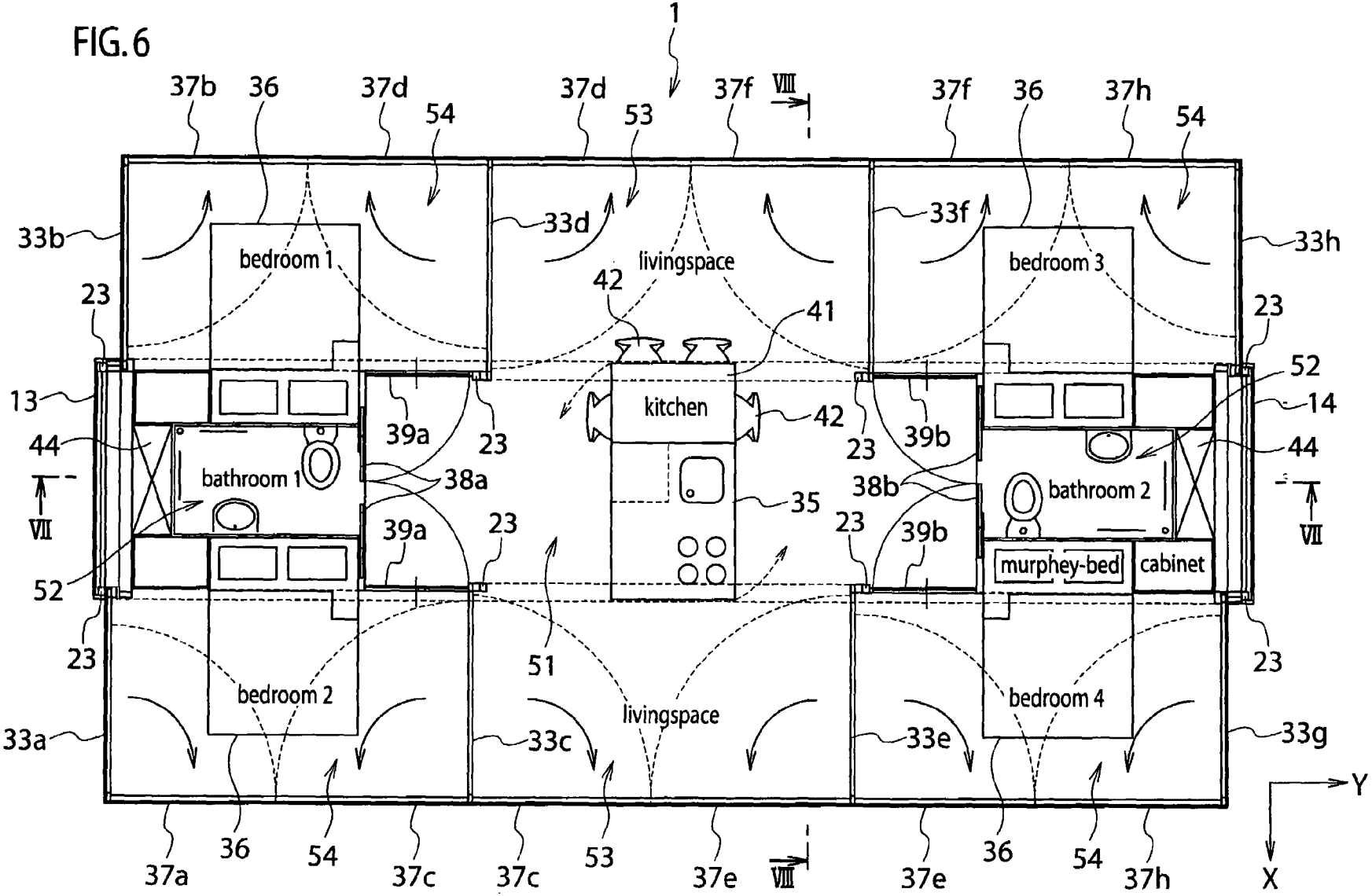
FIG. 6 is a horizontal sectional view of the movable prefabricated container house according to the first embodiment in an expanded state.
Figure 7:
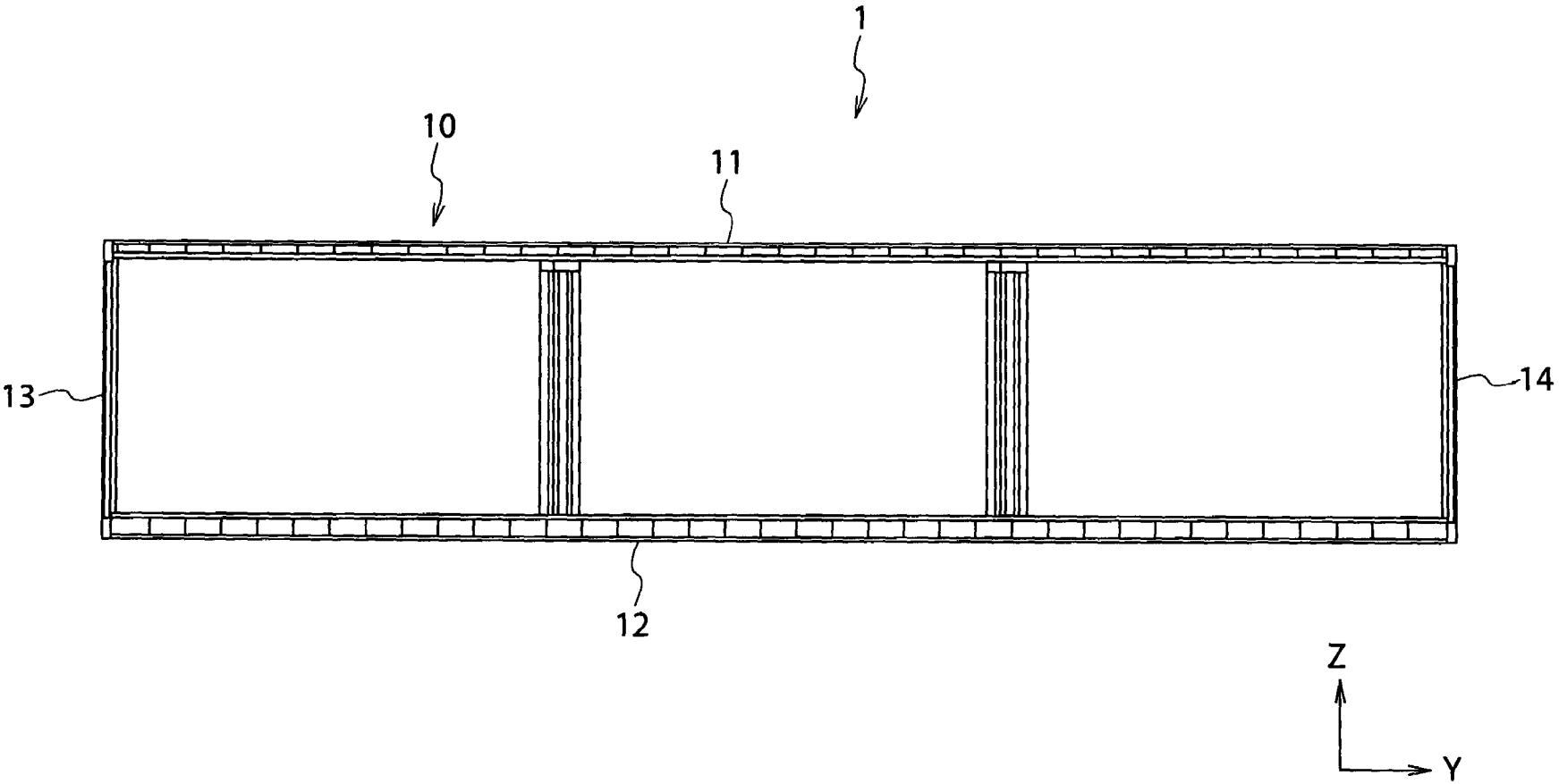
FIG. 7 is a sectional view taken along the direction indicated by arrows VII-VII of FIG. 6.
Figure 8:
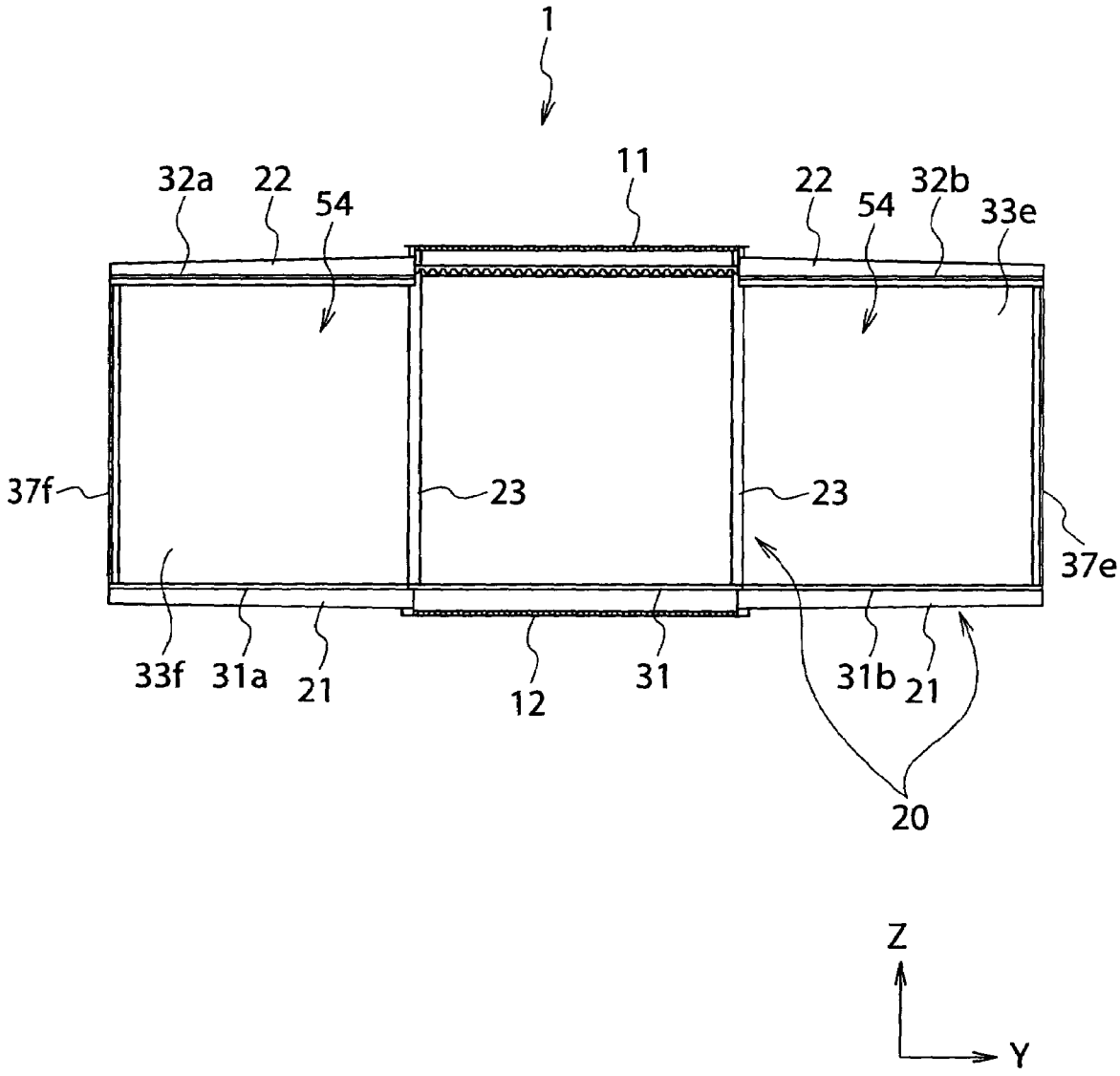
FIG. 8 is a sectional view taken along the direction indicated by arrows VIII-VIII of FIG. 6.

FIGS. 3 to 5 show sectional views each showing the inside of the movable prefabricated container house 1 before assembled (expanded) into a dwelling. FIGS. 6 to 8 show sectional views each showing the inside of the movable prefabricated container house 1 assembled (expanded) into the dwelling. FIGS. 9 to 16 are perspective views showing assembling (expanding) orders.

For the movable prefabricated container house 1, the main body A includes a main frame member 10, and the house forming body B includes dwelling forming members 30. Further, the movable prefabricated container house 1 of this embodiment includes a sub-frame member 20.

In this embodiment, the sub-frame member 20 and the dwelling forming members 30 to be described later are expanded, and whereby the house 1 is formed. The house 1 includes a central kitchen space 51; two bathrooms 52, 52 located on the respective front and rear sides of the kitchen space 51; two living spaces located on the respective left and right sides of the kitchen space 51; and four bedrooms 54 located on the respective left and right sides of each of the bathrooms 52, 52.

As shown in FIGS. 1 to 5, the main frame member 10 is formed of a pair of upper and lower rectangular plate-like horizontal frames 11, 12, and rectangular plate-like vertical frames 13, 14 connecting the pair of horizontal frames 11, 12 at each end thereof. The pair of upper and lower horizontal frames 11, 12, and the front and rear vertical frames 13, 14 are connected so that the main frame member 10 forms a shape like a container. Therefore, the main frame member 10 can be transported by the trailer truck as a normal container.

The pair of horizontal frames 11, 12 are formed of an upper horizontal frame 11 and a lower horizontal frame 12. These horizontal frames 11, 12 have predetermined widths and predetermined lengths. The width is, for example, approximately equal to the width of the kitchen space 51, and the length is, for example, approximately equal to the total length of the kitchen space 51 and the two living spaces 53, 53 on the both sides of the kitchen space 51. These horizontal frames 11, 12 each have a shape long in the horizontal direction. In addition, the horizontal frames 11 and 12 are disposed in parallel to each other. Here, the upper horizontal frame 11 forms a ceiling of the house 1, and the lower horizontal frame 12 forms a floor of the house 1.

The vertical frames 13, 14 are formed of a front vertical frame (a vertical frame to be located on the front side when loaded on the trailer truck) 13 connecting the horizontal frames 11, 12 at the front ends thereof in the vertical direction, and of a rear vertical frame (a vertical frame to be located on the rear side when loaded on the trailer truck) 14 connecting the horizontal frames 11, 12 at the rear ends thereof in the vertical direction. The front vertical frame 13 forms a front wall of the house 1, and the rear vertical frame 14 forms a rear wall of the house 1.

As described above, the main frame member 10 is formed by connecting both ends of the horizontal frames 11, 12 that are long in a front and rear direction using the vertical frames 13, 14, so that the main frame member 10 as a whole forms a (rectangular) box shape with openings 10*a* (see FIG. 10) on each side thereof.

In the house 1, an outer shell is formed of the horizontal frames 11, 12 and the vertical frames 13, 14. Therefore, the horizontal frames 11, 12 and the vertical frames 13, 14 are formed from a material with a strength being equal to or larger than a predetermined value. As the material, for example, a plate having a predetermined thickness such as a flat steel plate or a corrugated steel plate; a resin plate; a sandwich plate which a heat insulating material is interposed between the foregoing steel plates or the like; or a layered plate in which an heat insulating material is layered on a surface of the foregoing steel plate can be selected. Use of a heat insulating material enables the inside and outside of the house 1 to be thermally insulated from each other, thus improving comfortability of the house 1.

The sub-frame member 20 includes a plurality of floor supporting frames (beams) 21 and a plurality of ceiling supporting frames (beams) 22. The floor supporting frames 21 and the ceiling supporting frames 22 are beams of steel or the like.

As shown in FIG. 2, the floor supporting frames 21 are disposed on both sides of the lower horizontal frame 12 in the width direction (X axis direction in FIG. 2) thereof, and the ceiling supporting frames 22 are disposed on both sides of the upper horizontal frame 11 in the width direction thereof (however, the floor supporting frames 21 and the ceiling supporting frames 22, both on the left side when viewed from the trailer truck side, are omitted in the drawing). The plurality of floor supporting frames 21 are disposed on upper part of the lower horizontal frame 12 in its longitudinal direction (Y axis direction in FIG. 2). The plurality of ceiling supporting frames 22 are disposed on lower part of the upper horizontal frame 11 in its longitudinal direction. When housed, the floor supporting frames 21 and the ceiling supporting frames 22 are disposed so as not to protrude from the corresponding lower horizontal frame 12 or the upper horizontal frame 11. That is, the floor supporting frames 21 and the ceiling supporting frames 22 are housed in the main frame member 10 in a housed state, and can be drawn outward, when used.

Figure 9:
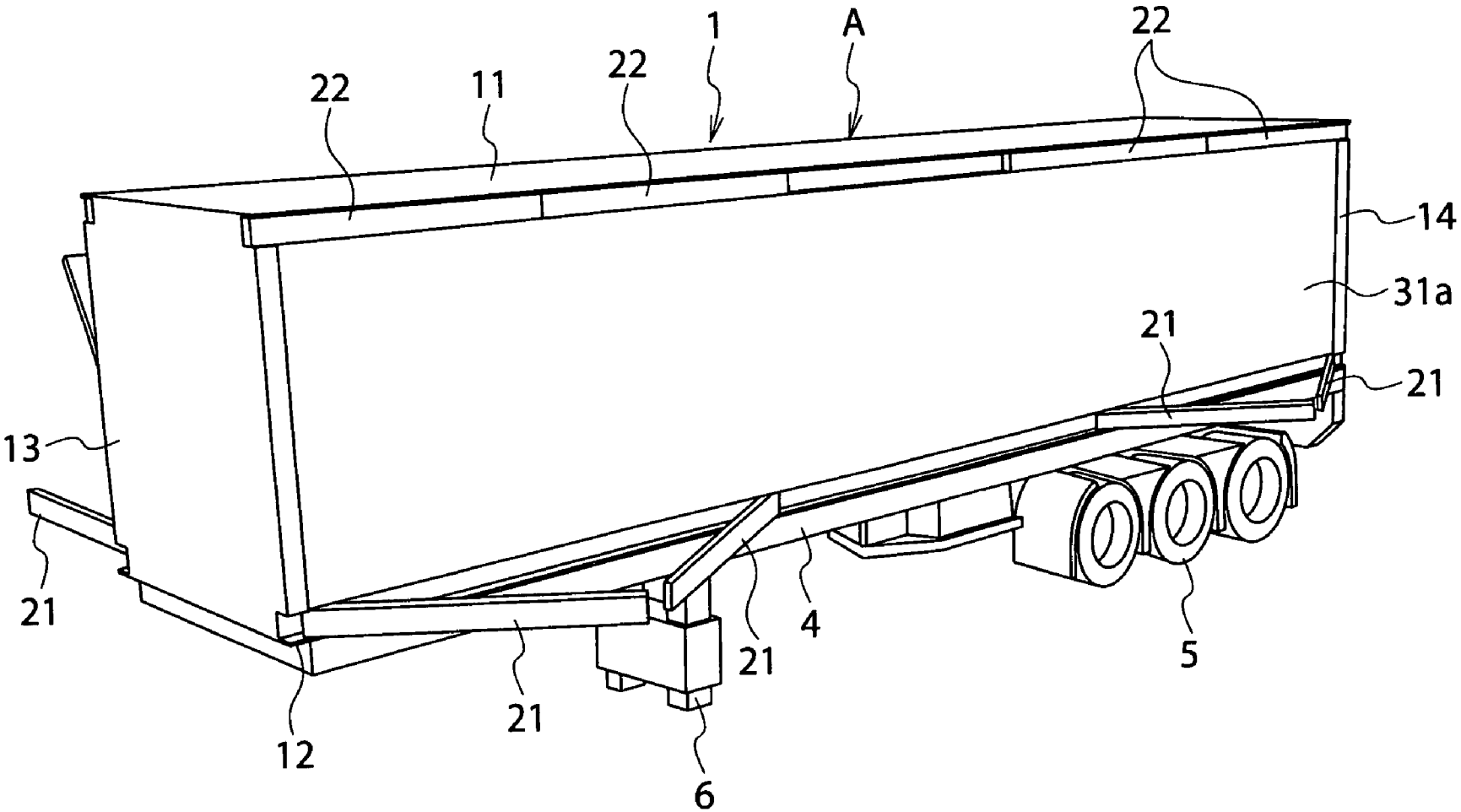
FIG. 9 is a perspective view showing a step in which floor supporting frames are drawn outward.

Each of the plurality of floor supporting frames 21 has an unillustrated pivot on an end in the longitudinal direction, and is rotatably connected to the lower horizontal frame 12 with the pivot. As shown in FIG. 9, each of the floor supporting frames 21 is about the pivot, so as to be drawn outward from the lower horizontal frame 12. The floor supporting frames 21 thus drawn extend horizontally in parallel to each other. Further, the floor supporting frames 21 are rotationally fixed with a bolt, a hook, or the like, so that the drawn floor supporting frames 21 are kept drawn outward. The drawn and fixed floor supporting frames 21 support thereon floor plates 31 to be described later.

Figure 11:
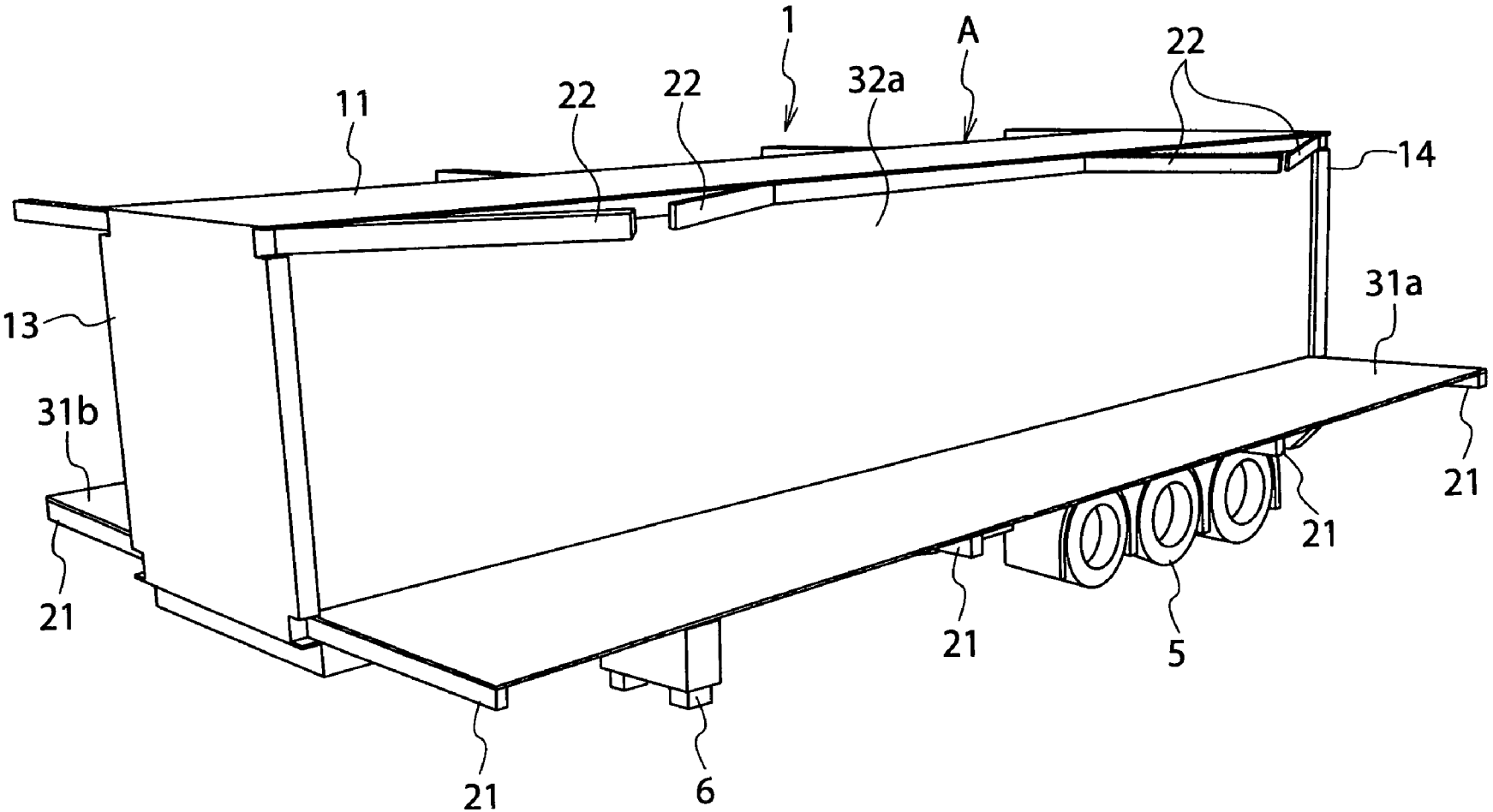
FIG. 11 is a perspective view showing a step subsequent to that of FIG. 10 and shows ceiling supporting frames for the support of ceiling board drawn out.

Similarly, each of the plurality of ceiling supporting frames 22 has an unillustrated pivot on an end in the longitudinal direction, and is rotatably connected to the upper horizontal frame 11 with the pivot. As shown in FIG. 11, each of the ceiling supporting frames 22 is rotated about the pivot, so as to be drawn outward from the upper horizontal frame 11. The ceiling supporting frames 21 thus drawn extend horizontally in parallel to each other. Further, the ceiling supporting frames 22 are rotationally fixed with a bolt, a hook, or the like, so that the drawn ceiling supporting frames 22 can be kept drawn outward. The drawn and fixed floor supporting frames 21 support thereon ceiling plates 32 to be described later.

The sub-frame member 20, further, includes reinforcing columns 23. As shown in FIG. 8, the reinforcing columns 23 are disposed in the vertical direction between the upper horizontal frame 11 and the lower horizontal frame 12. In addition, as shown in FIGS. 3 and 6, the reinforcing columns 23 are disposed at predetermined intervals in the longitudinal directions of the upper horizontal frame 11 and the lower horizontal frame 12. The reinforcing columns 23 are disposed in the above-described manner so as to reinforce the upper horizontal frame 11 and the lower horizontal frame 12, i.e., the main frame member 10, in the longitudinal direction thereof. Accordingly, even when the main frame member 10 is made longer, the main frame member 10 can securely maintain its box shape, with neither an inflection nor a deflection occurring in the upper horizontal frame 11 and the lower horizontal frame 12 in the middle thereof.

In this embodiment, the reinforcing columns 23 are disposed on positions on which respective spaces of the house 1 are partitioned. The dwelling forming members 30 to be described later is disposed in the main frame member 10, while using the reinforcing columns 23 as guide points. Subject to engineering with attention to overall strength of the main body (the container) and configuration (how many bodies or containers will be stacked on the main body), the reinforcing columns may be designed so that the columns can be moved to the edge or the sides of the containers or even be removed thereby providing clear and unobstructed, or nearly such, space within the containers.

The dwelling forming members 30 include movable floorboards 31 (31*a*, 31*b*), movable ceiling boards 32 (32*a*, 32*b*), movable wall panels 33 (33*a* to 33*h*), bath/toilet units 34, a kitchen unit 35, and bed units 36.

As shown in FIG. 5, the floorboards 31 are formed of a right movable floorboard 31*a* located on the right side of the main frame member 10, and a left movable floorboard 31*b* located on the left side thereof. In the same manner, the ceiling boards 32 are formed of a right movable ceiling board 32*a* located on the right side of the main frame member 10, and a left movable ceiling board 32*b* located on the left side thereof.

In this embodiment, the lengths in the Y axis direction of the right floorboard 31*a*, the right ceiling board 32*a*, the left floorboard 31*b*, and the left ceiling board 32*b* are each substantially the same as the lengths L in the Y axis direction of the upper and lower horizontal frames 11, 12 of the main frame member 10; and the heights thereof (widths thereof at the time when they are expanded) are each substantially the same as heights H of the vertical frames 13, 14 on the front and rear sides of the main frame member 10. Therefore, the right floorboard 31*a*, the left floorboard 31*b*, the right ceiling board 32*a*, and the left ceiling board 32*b* have sizes and shapes so that these floorboards and ceiling boards are fit into the rectangular openings 10*a* formed by the main frame member 10. Thus, in transporting the house 1, the floorboards 31*a*, 31*b* work as lids (covers) with which the openings 10*a* of the main frame member 10 are closed. These floorboards 31*a*, 31*b*, and the ceiling boards 32*a*, 32*b* are formed, for example, of metallic plates such as steel plates or aluminum plates, resin plates, wooden plates, or the like.

As shown in FIG. 5, when the house 1 remains unexpanded (before expanding), the right floorboard 31*a* and the right ceiling board 32*a* with the foregoing shapes and sizes are housed so that the right floorboard 31*a* and the right ceiling board 32*a* overlap within the opening 10*a* on the right side of the horizontal frames 11, 12. Meanwhile, the left floorboard 31*b* and the left ceiling board 32*b* are housed so that the left floorboard 31*b* and the left ceiling board 32*b* overlap within the opening 10*a* on the left side of the horizontal frames 11, 12. In this embodiment, the right floorboard 31*a* and the right ceiling board 32*a* overlap each other so that the right floorboard 31*a* is located outside the right ceiling board 32*a*; and the left floorboard 31*b* and the left ceiling board 32*b* overlap each other so that the left floorboard 31*b* is located outside the left ceiling board 32*b* (FIGS. 3 and 5). Thus, side walls of the container type dwelling, when transported, can be reinforced. This is because the floorboards 31*a*, 31*b* of the dwelling are rigidly formed compared with the ceiling boards 32*a*, 32*b* thereof, in general.

The right floorboard 31*a*, the left floorboard 31*b*, the right ceiling board 32*a*, and the left ceiling board 32*b* are overlapped and housed on the left and right sides of the horizontal frames 11, 12 in the above-described manner. Therefore, even when the floorboards 31*a*, 31*b*, and the ceiling boards 32*a*, 32*b* are even integrated, the size of the house 1 (or the container) in transportation is small and compact.

The overlapped right floorboard 31*a*, the left floorboard 31*b*, the right ceiling board 32*a*, and the left ceiling board 32*b* are drawn outward, when the house 1 is expanded.

In this embodiment, the movable floorboards 31*a*, 31*b* and the movable ceiling boards 32*a*, 32*b* include hinge shafts (not shown) at base ends thereof, and the hinge shafts are inserted into the main frame member 10. To be more specific, in the case of the floorboards 31*a*, 31*b*, the hinge shafts are inserted into portions of the main frame member 10 under the openings. Meanwhile, in the case of the ceiling boards 32*a*, 32*b*, the hinge shafts are inserted into portions of the main frame member 10 over the openings. The floorboards 31*a*, 31*b* and the ceiling boards 32*a*, 32*b* are drawn outward by rotating or swinging the floorboards 31 and the ceiling boards 32 pivotally about these hinge shafts. Incidentally, in order to rotatably support the floorboards 31*a*, 31*b* and the ceiling boards 32*a*, 32*b* on the main frame member 10, lower shafts and upper shafts may be provided to respective portions under and over the openings of the main frame member 10, and bearings for the respective shafts may be provided to base portions of the floorboards 31*a*, 31*b* and the ceiling boards 32*a*, 32*b*.

The wall panels 33 are formed of a first wall panel 33*a*, a second wall panel 33*b*, a third wall panel 33*c*, a fourth wall panel 33*d*, a fifth wall panel 33*e*, a sixth wall panel 33*f*, a seventh wall panel 33*g*, an eighth wall panel 33*h*, and outer wall panels 37*a* to 37*h* which are rotatably or swingably (pivotally) supported on these wall panels 33*a* to 33*h*.

These wall panels 33*a* to 33*h* are each formed so as to have a width and a height which are substantially equal to widths W and heights H of the front vertical frame 13 and the rear vertical frame 14 of the main frame member 10. The wall panels 33*a* to 33*h* are formed of metallic plates such as steel plates or aluminum plates, resin plates, wooden plates, or the like, similar to the floorboards 31*a*, 31*b* and the ceiling boards 32*a*, 32*b*.

The first wall panel 33*a* (and the outer wall panel connected thereto) and the second wall panel 33*b* (and the outer wall panel connected thereto) form a pair, and are overlapped and disposed near the reinforcing columns 23 on the side of the front vertical frame 13. In the same fashion, the seventh wall panel 33*g* (and the outer wall panel connected thereto) and the eighth wall panel 33*h* (and the outer wall panel connected thereto) form a pair, and are overlapped and disposed near the reinforcing columns 23 on the side of the rear vertical frame 14. Similarly, the third wall panel 33*c* (and the outer wall panels connected thereto) and the fourth wall panel 33*d* (and the outer wall panels connected thereto) form a pair; and the fifth wall panel 33*e* (and the outer wall panels connected thereto) and the sixth wall panel 33*f* (and the outer wall panels connected thereto) form a pair. The paired third and fourth wall panels 33*c* and 33*d* (and the outer panels connected thereto), and the paired fifth and the sixth wall panel wall panels 33*e* and 33*f* (and the outer panels connected thereto) are overlapped and disposed near the reinforcing columns 23 which support the upper and lower horizontal frames 11, 12 in the middle thereof (refer to FIG. 3). In this manner, these paired wall panels are overlapped and housed in the main frame member 10. Thus, the size of the house 1 (or the container) in transportation is small and compact and in standard size.

As shown in FIG. 6, the first wall panel 33*a*, the third wall panel 33*c*, the fifth wall panel 33*e*, and the seventh wall panel 33*g* (and the outer panels connected thereto) are slidably movable outward on the left side of the main frame member 10. More precisely, rails engageble with lower edges and upper edges of the wall panels 33 are provided on the upper surfaces of the movable floorboards 31 (31*a*, 31*b*) and the lower surfaces of the movable ceiling boards 32 (32*a*, 32*b*). Thus, the wall panels 33 drawn outward from the main frame member 10 are guided by the rails and moved in between the movable floorboards 31 (31*a*, 31*b*) and the movable ceiling boards 32 (32*a*, 32*b*) to be disposed in predetermined positions. Further, the second wall panel 33*b*, the fourth wall panel 33*d*, the sixth wall panel 33*f*, and the eighth wall panel 33*h* (and the outer panels connected thereto) are slidably movable outward on the right side of the main frame member 10.

As described above, the outer wall panels 37*a* to 37*h* are rotatably connected to the wall panels 33*a* to 33*h*. In the unexpanded house 1, the outer wall panels 37*a* to 37*h* are folded so as to overlap the corresponding wall panels 33*a* to 33*h*. As shown in FIG. 6, in this embodiment, the outer wall panels 37*a*, 37*b*, 37*g*, and 37*h*, each representing one piece of wall panel, are rotatably connected to the first wall panel 33*a*, the second wall panel 33*b*, the seventh wall panel 33*g*, and the eighth wall panel 33*h*, which are located on the front and rear sides of the main frame member 10. Meanwhile, the outer wall panels 37*c*, 37*d*, 37*e*, and 37*f*, each representing two pieces of wall panels, are rotatably connected to the third wall panel 33*c*, the fourth wall panel 33*d*, the fifth wall panel 33*e*, and the sixth wall panel 33*f*, which are located in the middle of the main frame member 10 in the longitudinal direction thereof. Each pair of two outer wall panels 37*c*, 37*d*, 37*e*, or 37*f* rotate in opposite directions to each other.

When the house 1 is expanded, the outer walls 37*a* to 37*h* each rotate outward. With this rotation, the outer walls 37*a* to 37*h* form walls of the house 1. The outer walls 37*a* to 37*h* are formed of metallic plates such as steel plates or aluminum plates, resin plates, wooden plates, or the like.

As shown in FIGS. 3 and 6, partition panels 38 (38*a*, 38*b*) are disposed in the middle of the upper and lower horizontal frames 11, 12 of the main frame member 10 in the longitudinal direction thereof. The partition panels 38 partition the main frame member 10 into a plurality of sub-spaces in the longitudinal direction thereof. A first partition panel 38*a* located on the front side of the main frame member 10 forms a bathroom 52 on the front side of the main frame member 10. In this front bathroom 52, a bath/toilet unit 34 is disposed. A second partition panel 38*b* located on the rear side of the main frame member 10 forms another bathroom 52 on the rear side of the main frame member 10. In this rear bathroom 52, another bath/toilet unit 34 is disposed. In addition, in the bathrooms 52, water storage/drainage tanks 44 are disposed. The water storage/drainage tank 44 is separated into two parts. The upper part thereof is a water storage tank and the lower part thereof is a water drainage tank for the toilet. The provision of the water storage/drainage tank 44 enables the bath/toilet unit 34 to be used.

As shown in FIG. 3 two door panels 39*a* are disposed near the first partition panel 38*a*. In addition, two door panels 39*b* are disposed near the second partition panel 38*b*. As shown in FIG. 6, these door panels 39*a* and 39*b* are supported on the main frame member 10 rotatably about vertical axes. Thus, the door panels 39*a*, 39*b* become rotatable when the house 1 is expanded, whereby entrances to the respective bedrooms 54 are formed.

In this embodiment, the four bedrooms 54 are provided at four corners, and each include a bed unit 36 disposed therein. The bed unit 36 is supported on a portion under the opening of the main frame member 10 swingably (pivotally) about a horizontal axis. Accordingly, when the house 1 remains unexpanded (when the house 1 is transported), the bed units 36 are folded in a horizontal position (attitude). In contrast, when the house 1 is expanded, the bed units are drawn down to a horizontal position and can be used as beds.

In this embodiment, the kitchen unit 35 is disposed in the kitchen space 51 at the center of the house 1. The kitchen unit 35 includes a table 41 and chairs 42 which can be drawn therefrom (refer to FIG. 6). Alternatively, table 41 and chairs 42 provided separately from the kitchen unit 35 may be provided in proximity thereto, when used.

Further, as an entrance from the outside into the house 1, a door may be provided in advance to any one of the outer wall panels 37*c*, 37*d*, 37*e*, and 37*f*. Further, even when the house 1 is used in the size being equal to that of the main frame member 10 as shown in FIG. 2, the providing of doors for passage, in advance, to outer wall panels and partition panels enables one to get in or out of partitioned spaces.

Next, steps for expanding the movable prefabricated container house 1 of this embodiment are described with reference to FIGS. 9 to 16.

FIG. 9 shows how the floor supporting frames 21 are drawn outward from the main frame member 10 after the state of FIG. 2 in which the chassis 4 has been detached from the trailer truck 2. Each of the floor supporting frames 21 rotates about the pivot so that the floor supporting frame 21 can be drawn outward from the main frame member 10 and extends horizontally.

Figure 10:
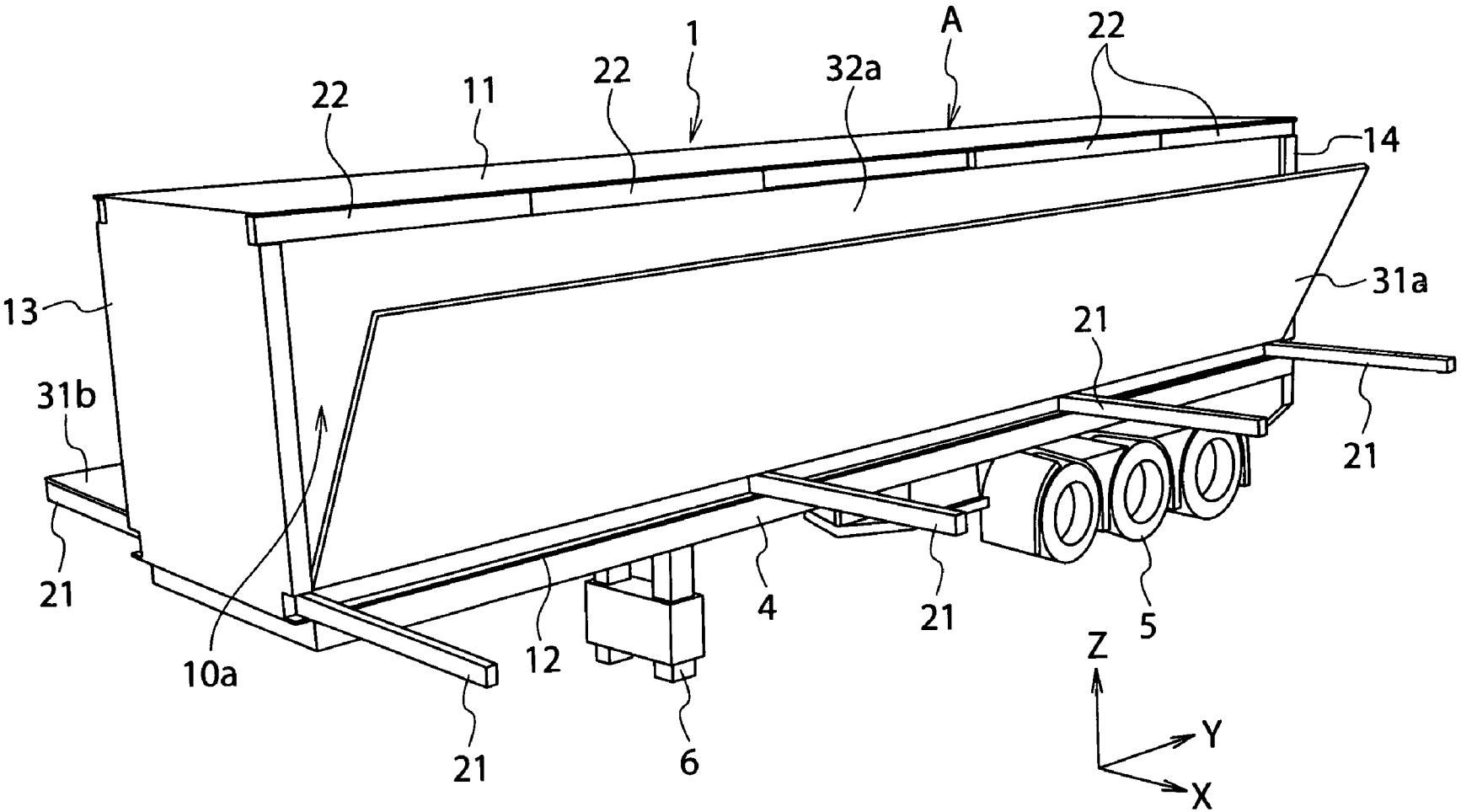
FIG. 10 is a perspective view showing a step subsequent to that of FIG. 9.

The floor supporting frame 21 thus drawn is fixed on that position and, thereafter, the left and right (in the X axis direction) floorboards 31*a*, 31*b* are drawn outward as shown in FIG. 10. The left and right floorboards 31*a*, 31*b* can be drawn by rotating the floorboards 31*a* and 31*b* outward and downward about the hinge shafts provided to lower portions. The drawn left and right floorboards 31*a*, 31*b* are supported on the floor supporting frame 21 and extend horizontally (refer to FIG. 11).

FIG. 11 shows a step subsequent to that of FIG. 10, and shows how each of the ceiling supporting frame 22 is drawn outward from the main frame member 10. The ceiling supporting frame 22 rotates about the pivot so that the ceiling supporting frame 22 can be drawn outward and extends horizontally. After drawn, the ceiling supporting frame 22 is fixed while extending horizontally.

Figure 12:
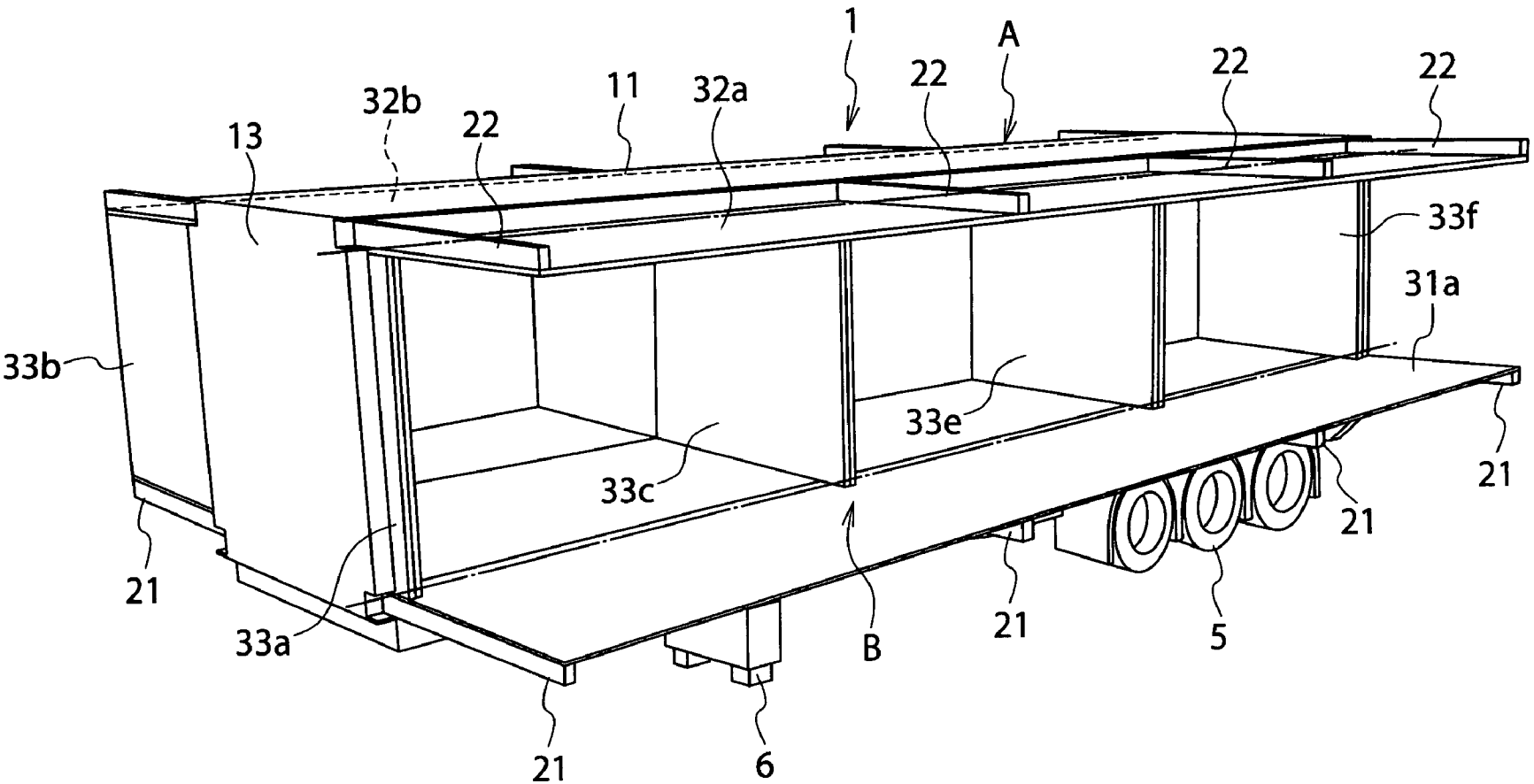
FIG. 12 is a perspective view showing a step subsequent to that of FIG. 11.

FIG. 12 shows a step subsequent to that of FIG. 11. The left and right ceiling boards 32*a* and 32*b* are rotated outward and upward about hinge shafts. As a result of this rotation, the right and left ceiling boards 32*a*, 32*b* thus drawn come into contact with the ceiling supporting frames and extend horizontally. These ceiling boards 32*a*, 32*b* are fixed to the ceiling supporting frames 22 with bolts, hooks, or the like.

Figure 13:
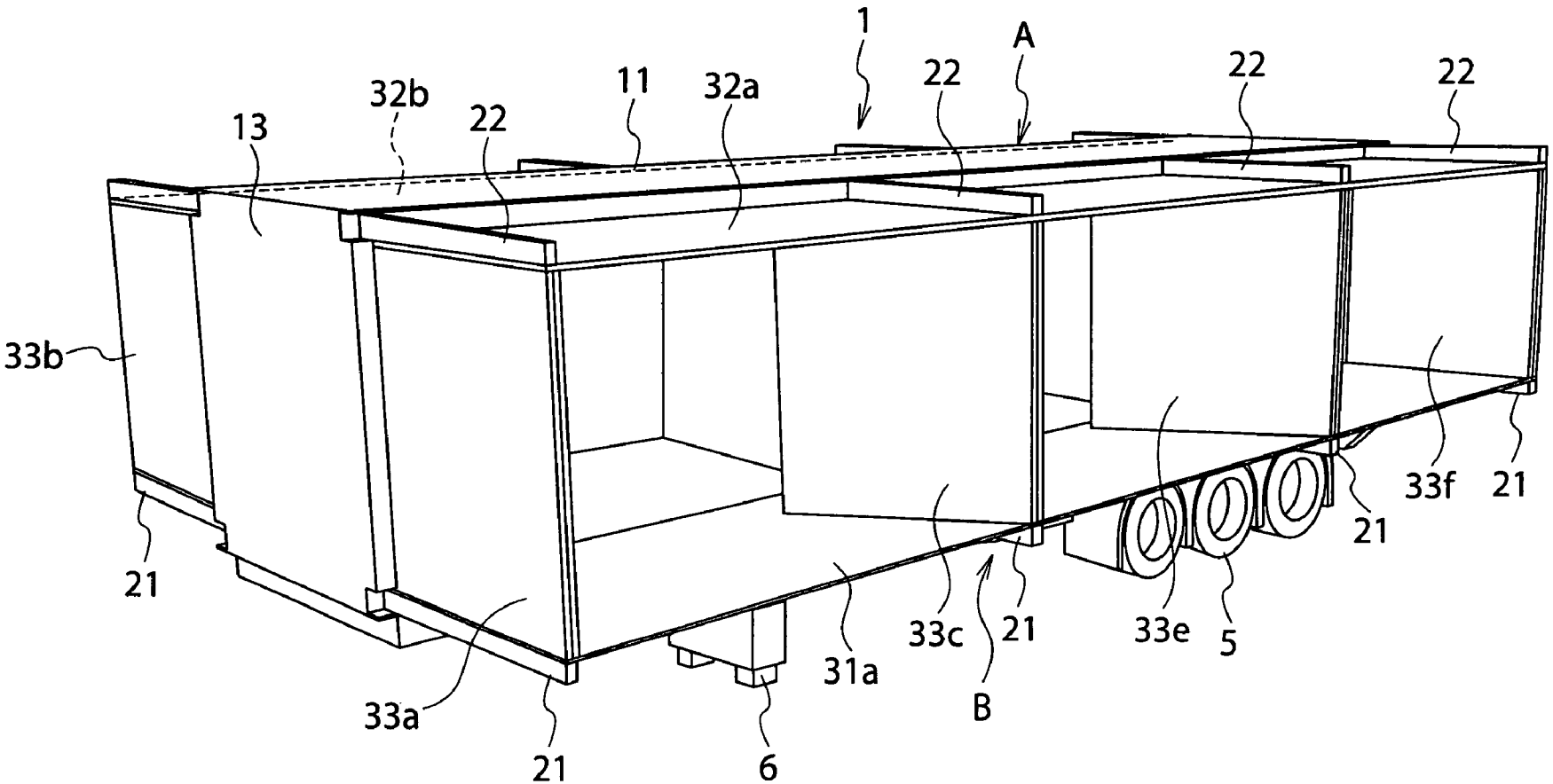
FIG. 13 is a perspective view showing a step subsequent to that of FIG. 12.

FIG. 13 shows a step subsequent to that of FIG. 12. Each of the wall panels 33*a* to 33*h* is slid and drawn outward. Thus, the space inside a room formed with the left and right floorboards 31*a*, 31*b* and with the left and right ceiling boards 32*a*, 32*b* are partitioned with the wall panels 33*c* to 33*f*. Further, the wall panels 33*a*, 33*b* and the wall panels 33*g*, 33*h* isolate the space inside the room from the space outside the room.

Figure 14:
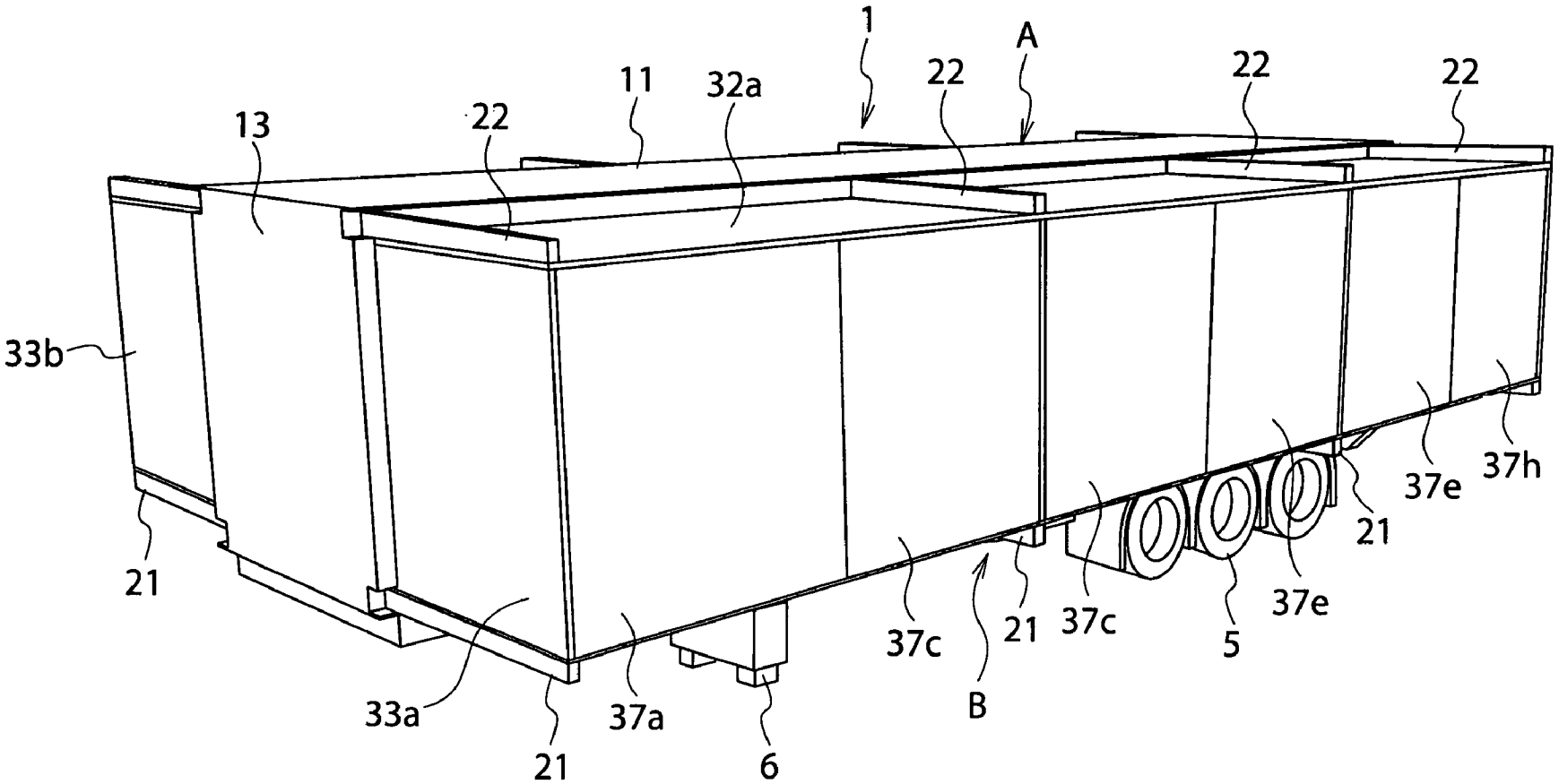
FIG. 14 is a perspective view showing a step subsequent to that of FIG. 13.

FIG. 14 shows a step subsequent to that of FIG. 13. The outer wall panels 37*a* to 37*h* are rotated and drawn outward from the corresponding wall panels 33*a*. The outer wall panels 37*a* to 37*h* drawn outward form outer walls of the house 1 as shown in FIG. 14.

Figure 15:
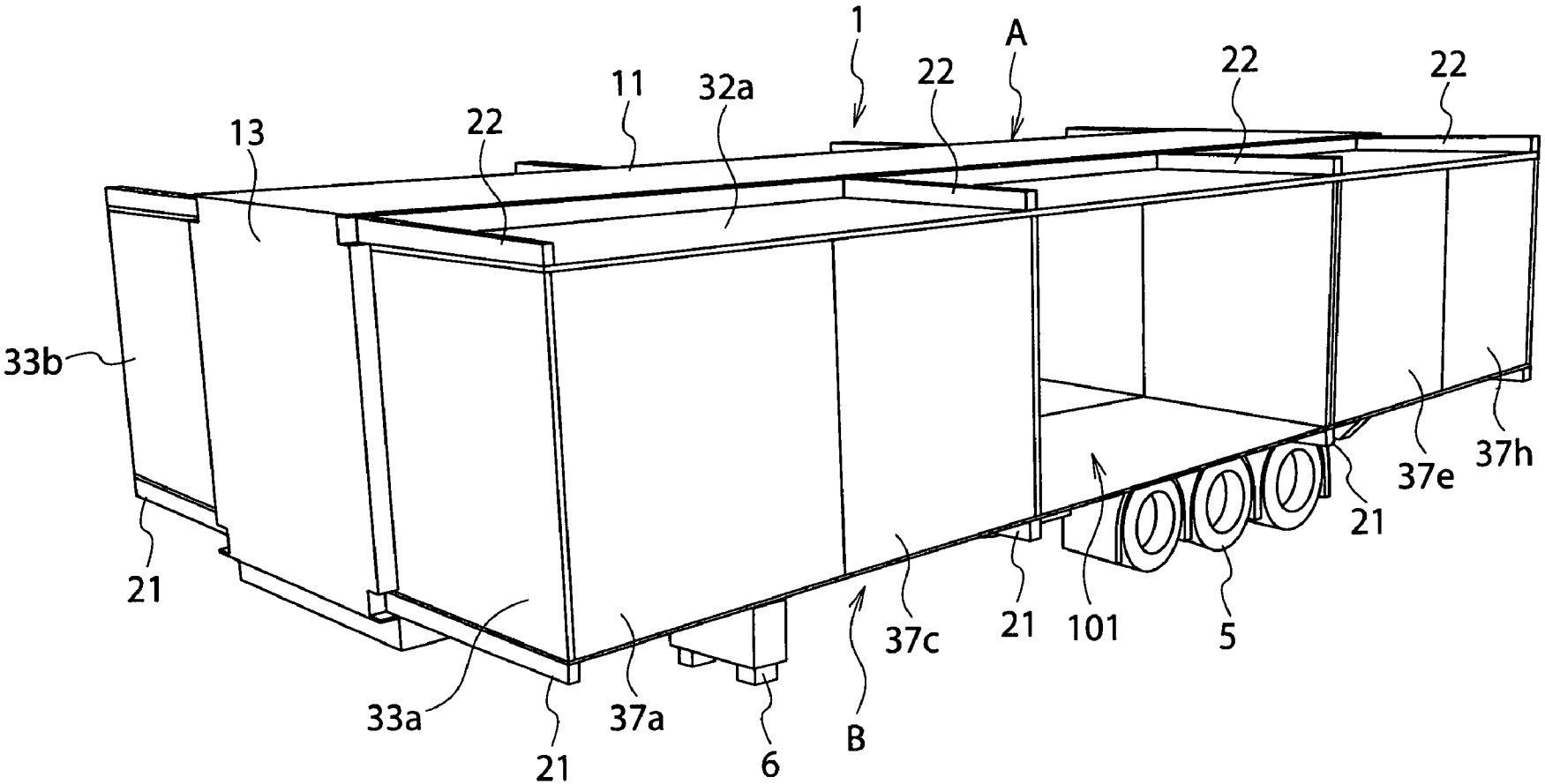
FIG. 15 is a perspective view showing a step in which a doorway is formed, this step being subsequent to that of FIG. 14.

FIG. 15 shows a step subsequent to that of FIG. 14. One of the two outer wall panels 37*c* of the third wall panel 33*c*, one of the two outer wall panels 37*d* of the fourth wall panel 33*d*, one of the two outer wall panels 37*e* of the fifth wall panel 33*e*, and one of the two outer wall panels 37*f* of the sixth wall panel 33*f* are rotated into the main frame member 10. As a result of this rotation, an entrance 101 of the house 1 is formed. Here, one of the two outer wall panels 37*c* of the third wall panel 33*c*, one of the two outer wall panels 37*d* of the fourth wall panel 33*d*, one of the two outer wall panels 37*e* of the fifth wall panel 33*e*, and one of the two outer wall panels 37*f* of the sixth wall panel 33*f* may not be rotated into the main frame member 10, and a door provided in advance to any one of the outer wall panels 37*c*, 37*d*, 37*e*, and 37*f* may be used as an entrance of the house 1.

Figure 16:
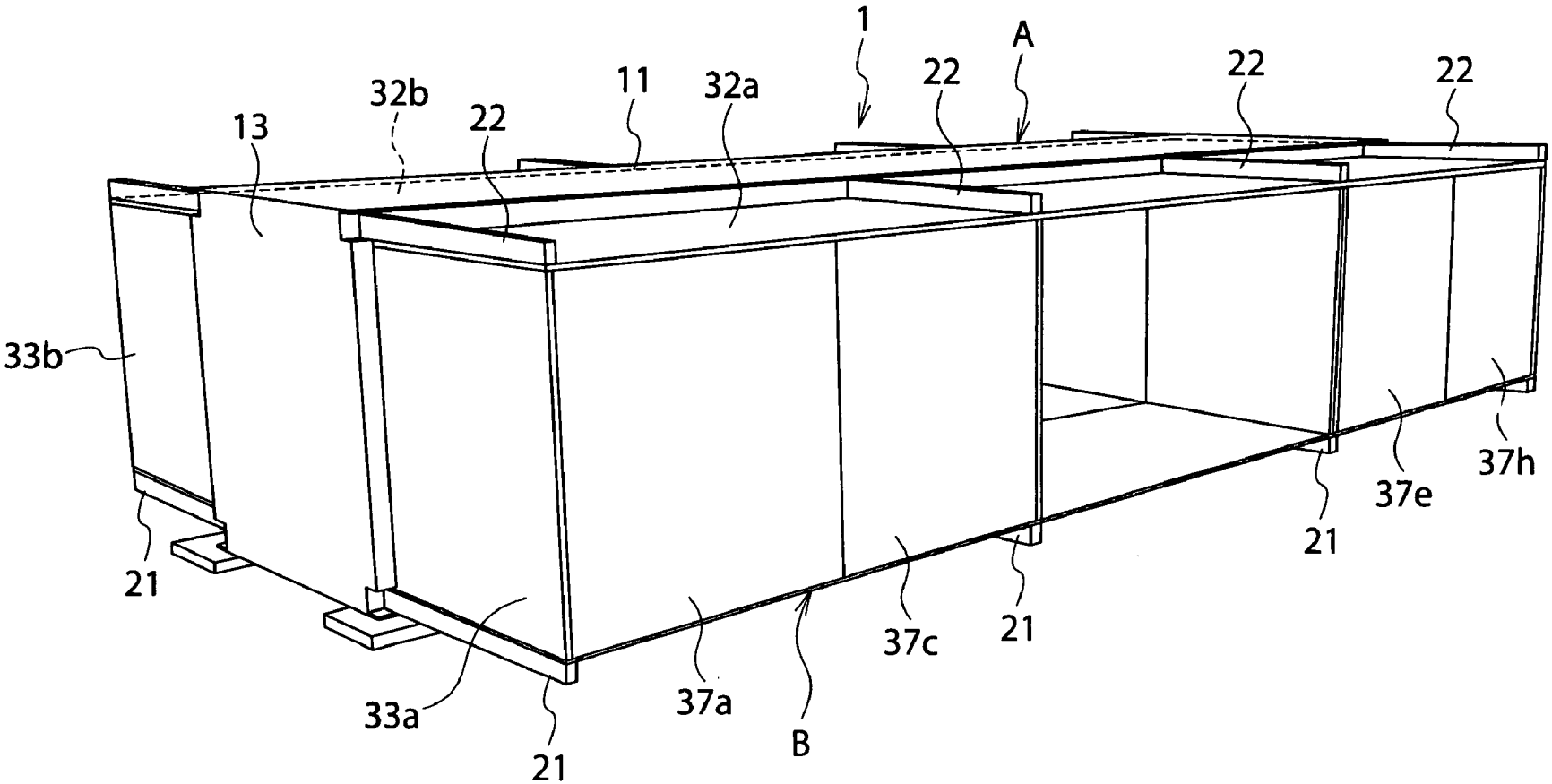
FIG. 16 is a perspective view showing a state in which the movable prefabricated container house is set up at an installation site.

FIG. 16 shows a step in which the house 1 of FIG. 15 with the entrance formed therein is set up on the ground. The entire house 1 is lifted by a crane or the like to be unloaded from the chassis 4, and set on the ground at an installation position. Once a state of FIG. 16 is achieved, it becomes possible for anyone to walk in and out of the house 1.

Incidentally, as described above, the house 1 in the container may be unloaded from the chassis 4 and set on the ground, before the wall panels 33*a* to 33*h* are expanded on the floorboards 31*a*, 31*b*, and the ceiling boards 32*a*, 32*b*. Thereafter, the wall panels 33*a* to 33*h* may be expanded on the floorboards 31*a*, 31*b* and the ceiling boards 32*a*, 32*b*.

Next, as shown in FIG. 6, door panels 39*a*, 39*b* are rotated to partition the inside of the house 1 into four bedrooms 54 and also form two living spaces 53. In each of the bedrooms 54, the bed unit 36 is drawn down to a horizontal position for use. Therefore, the house 1 is formed in which the kitchen space 54 is located at the center, two living spaces 54 are disposed on the left and right sides of the kitchen space 51, and two bedrooms 54 are disposed on the front and rear sides of each of the two living spaces 53.

In the embodiment described above, the main frame member 10 of container-type unit serves as an outer shell of the house 1 and the movable prefabricated container house can be used as a dwelling. Accordingly, the amount of cumbersome assembly work at the destination can be reduced to the minimum. Further, since the main frame member 10 can be pulled by the trailer truck 2, the movable prefabricated container house can be moved to any place. In addition, the dwelling forming members 30 housed in the main frame member 10 is easily drawn and assembled. Thus, a plurality of the living spaces 53 and a plurality of the bedrooms 54 can be drawn and formed to the left and right sides of the main frame member 10. Therefore, an easy expansion and assembling of the dwelling are made possible even for non-specialized workers, and an extended living space nearly triple the size of the main body can be obtained.

Disassembling the movable prefabricated container house 1 from the state of a dwelling back to the state of a non-expanded container house which can be transported or moved to an installation site as shown in FIGS. 1-5 can be performed by taking reverse procedures to expanding and assembling described above.

Figure 17:
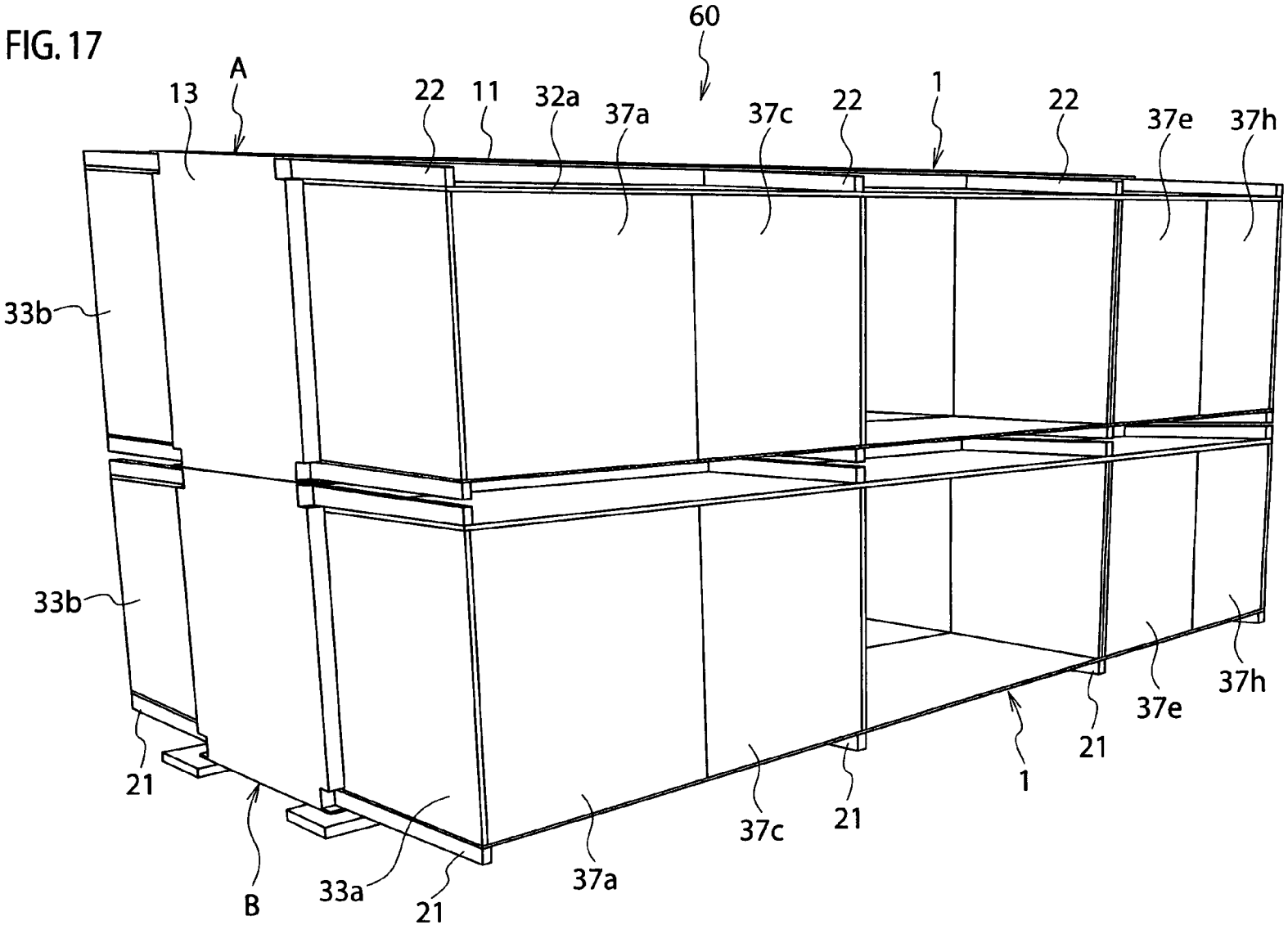
FIG. 17 is a perspective view showing a state in which a two-story dwelling is formed.

FIG. 17 shows a two-story dwelling 60 formed by stacking the house 1 of the first embodiment on another house being the same as the house 1. Upper and lower houses 1, 1 are stacked so that the main frame members 10 can come into contact with each other. The upper and lower houses 1, 1 can be expanded by performing the same operations as those described in the first embodiment. These expanded houses are stacked vertically and connected, for example, with bolts or the like. Thus, the two-story dwelling 60 can be formed. In this instance, openings with openable and closable or detachable doors may be provided in a ceiling of the lower house 1 and a floor of the upper house 1 at the corresponding positions of the upper and lower houses 1. And stairs may be placed enabling communications between the upper and lower houses 1. Stairs may be set up against the upper house 1 directly from the outside enabling communications between the inside of the upper house 1 and the outside.

In such an example shown in FIG. 17, an extension of the dwelling is simple. Accordingly, a further extended living space can be obtained. In this way, one or more house 1 may be stacked to form a tiered house so that space can be increased according to the number of units placed one on top of the other.

While not shown in the drawings, an auxiliary floorboard for extension and an auxiliary ceiling board for extension may be slidably provided to each of the left and right floorboards 31*a*, 31*b* and the left and right ceiling boards 32*a*, 32*b*. The auxiliary floorboards for extension and the auxiliary ceiling boards for extension are slid and moved outward after all the left and right floorboards 31*a*, 31*b* and the left and right ceiling boards 32*a*, 32*b* are rotated so as to extend horizontally. The sliding and extending of these auxiliary floorboards and auxiliary ceiling enables the floorboards and the ceiling boards to further extend outward. In this case, the living space is larger than that of the example of FIGS. 1 to 16. Therefore, the dwelling can be extended.

Figure 18:
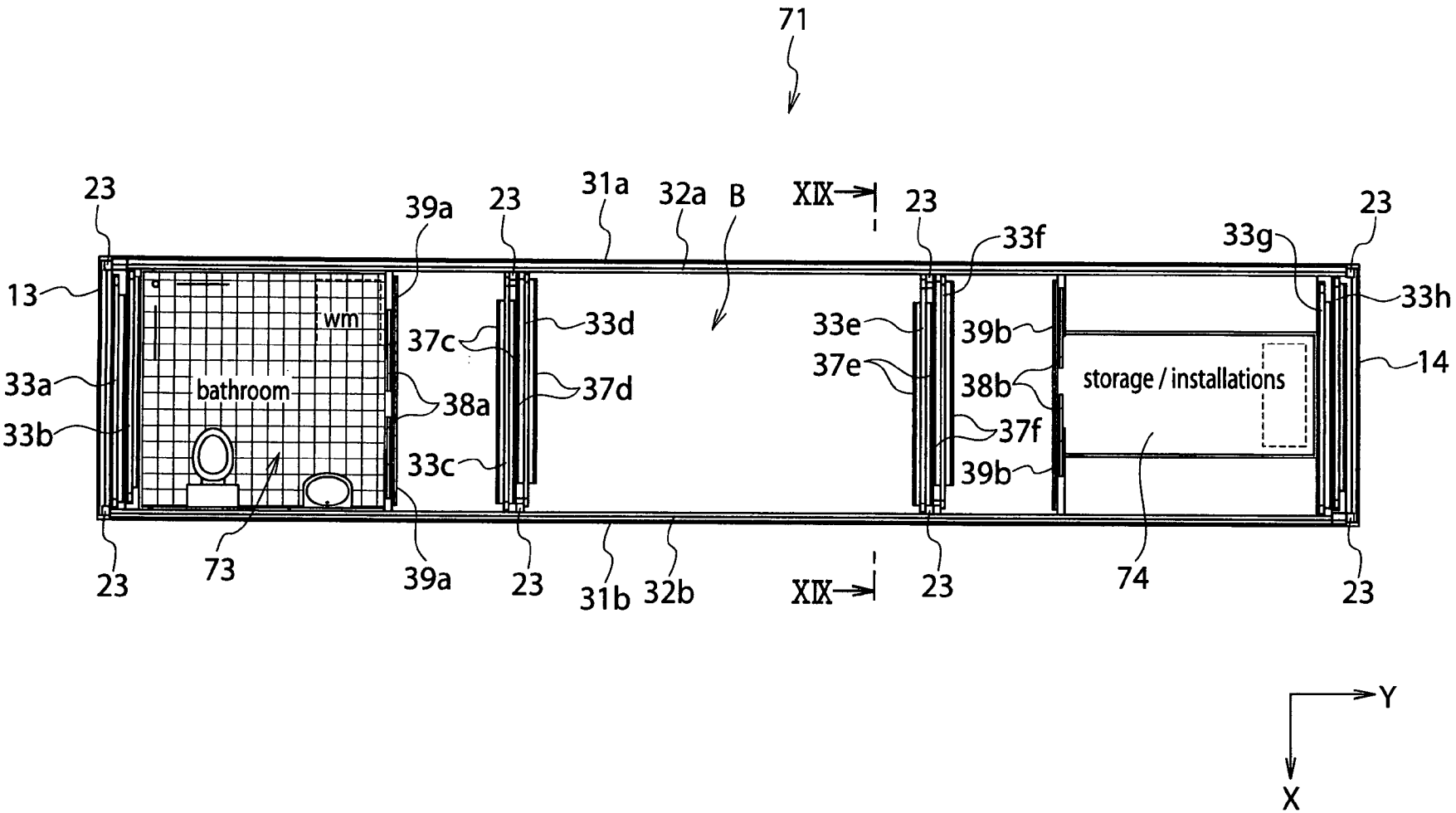
FIG. 18 is a horizontal sectional view of a movable prefabricated container house according to a second embodiment of the present invention in a non-expanded state.
Figure 19:
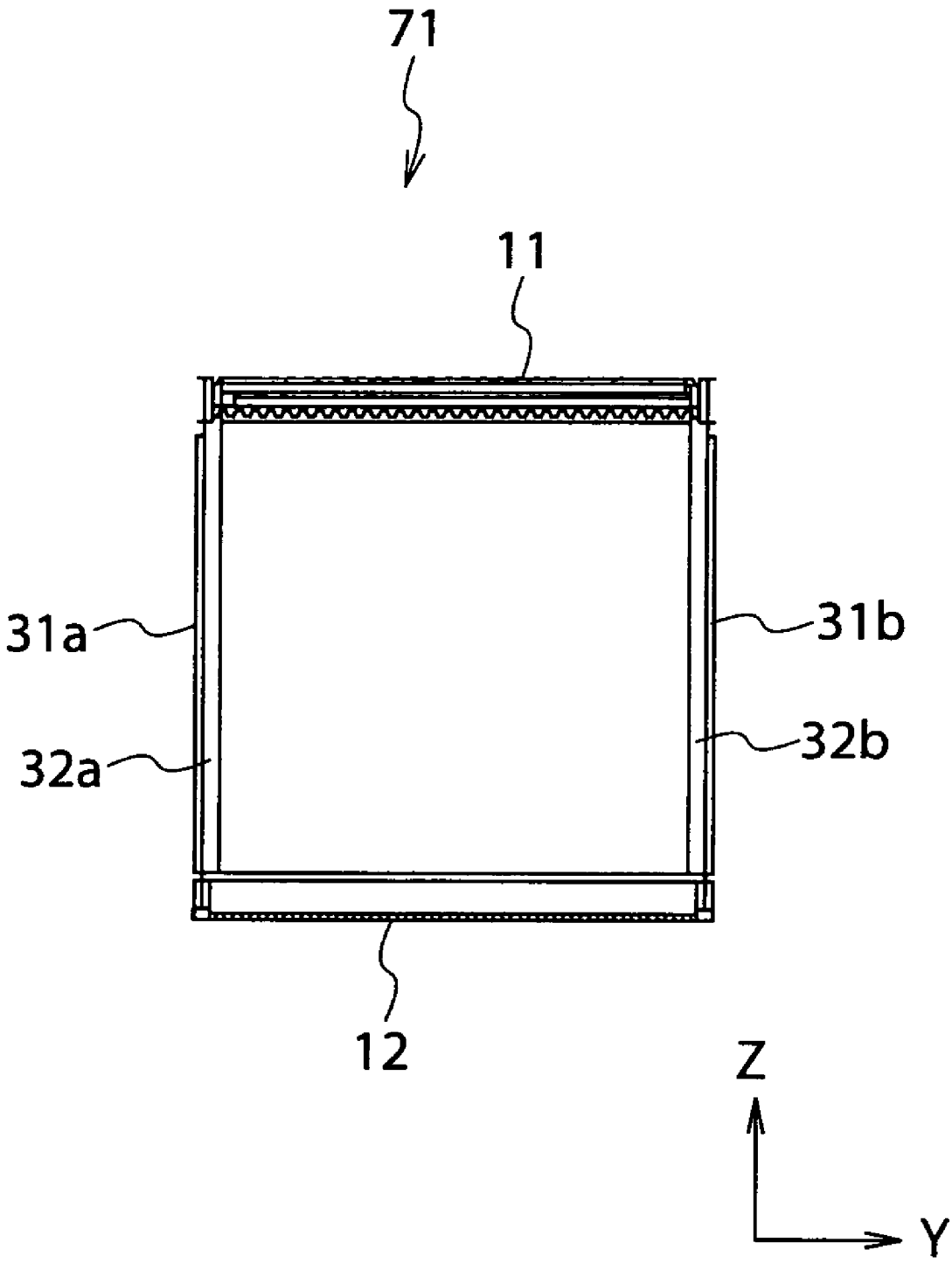
FIG. 19 is a sectional view taken along the direction indicated by arrows XIX-XIX of FIG. 18.
Figure 20:
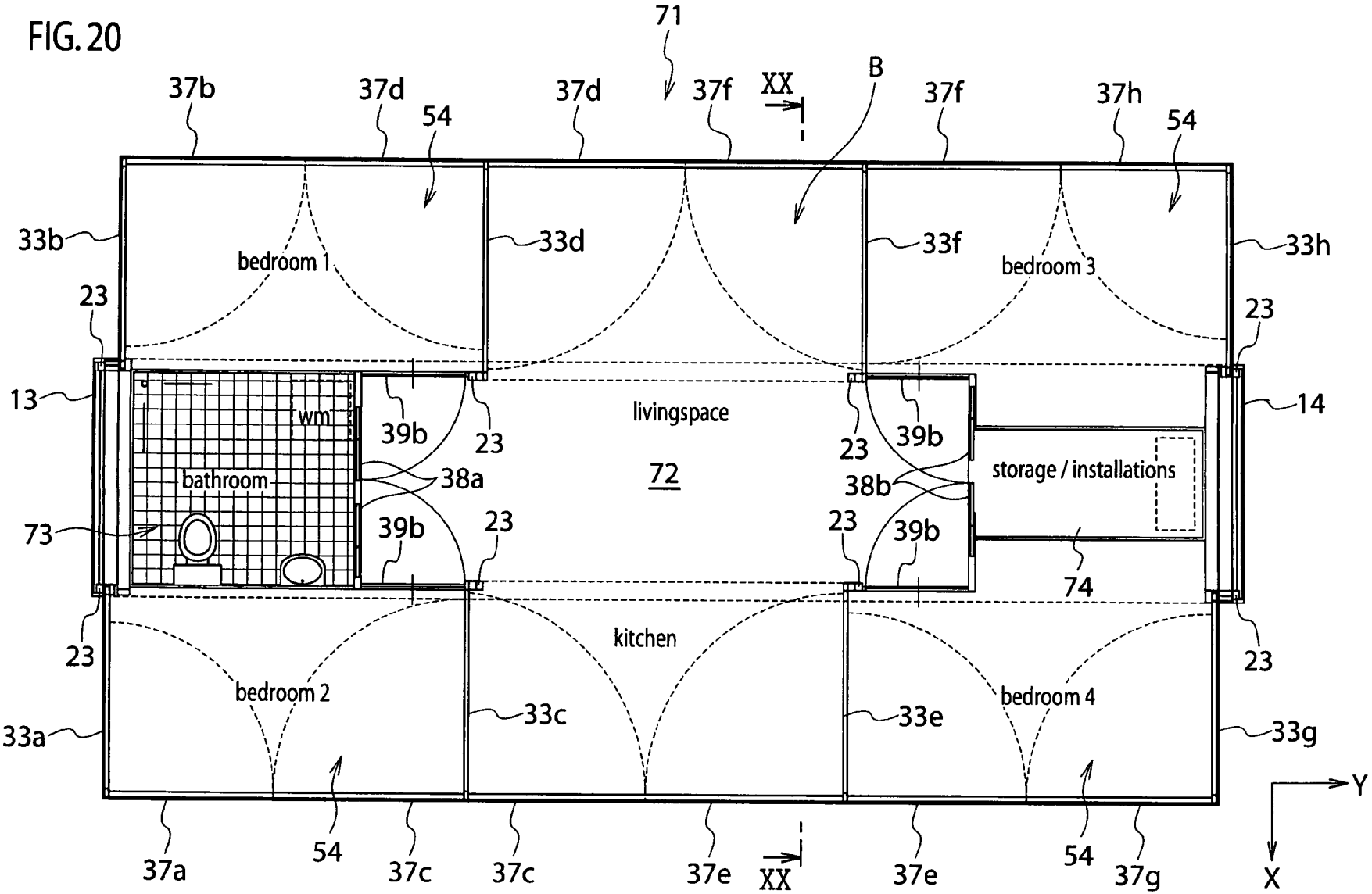
FIG. 20 is a horizontal sectional view of the movable prefabricated container house of FIG. 18 in an expanded state.
Figure 21:
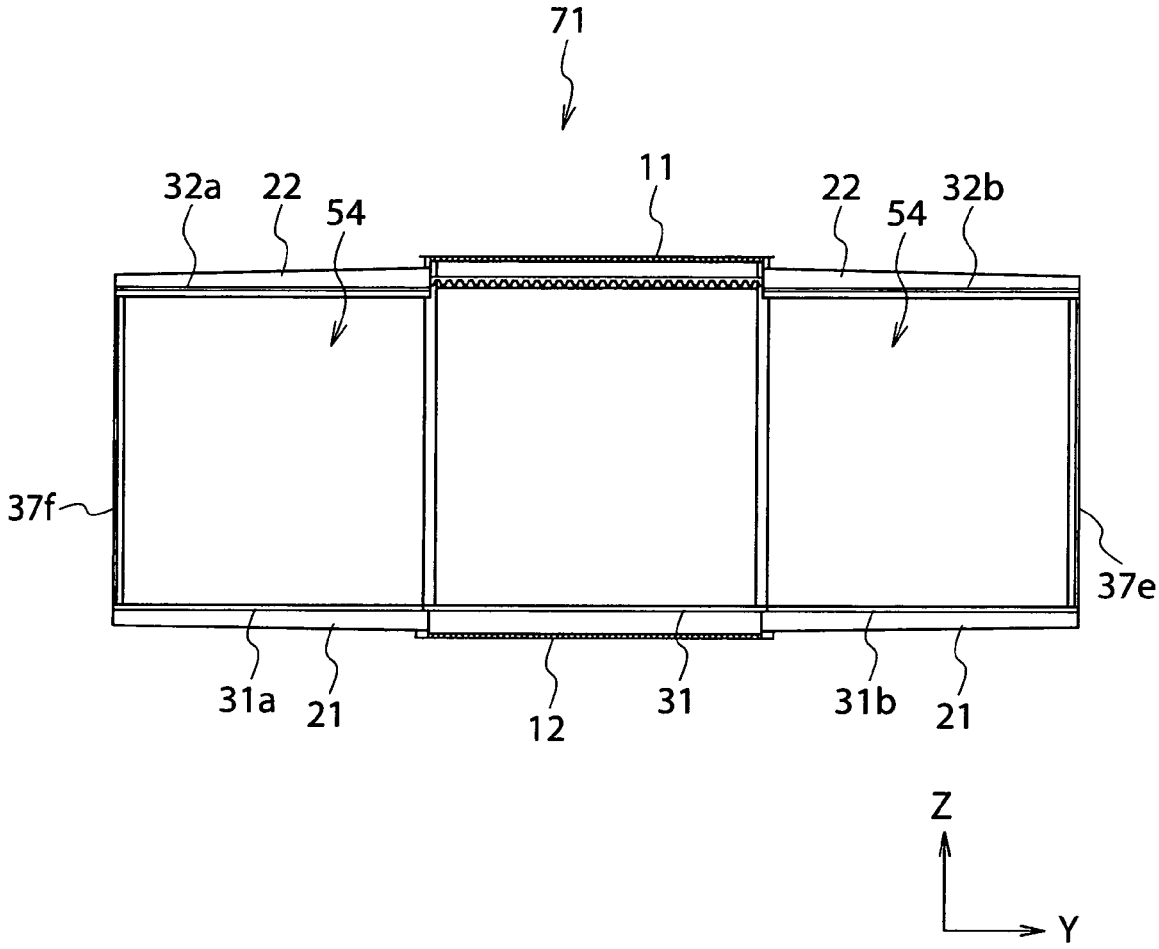
FIG. 21 is a sectional view taken along the direction indicated by arrows XX-XX of FIG. 20.

FIGS. 18 to 21 show a movable prefabricated container house 71 of a second embodiment; FIGS. 18 and 19 show sectional views in an unexpanded state; and FIGS. 20 and 21 show sectional views in an expanded state. In the movable prefabricated container house 71 of the second embodiment, components which are the same as those of the movable prefabricated container house 1 of the first embodiment are given the same symbols.

For the movable prefabricated container house 71, a living space is provided in the middle, and a bathroom 73 is provided on the front side of the living space 72. In addition, a storage 74 is provided on the rear side of the living space 72. The bathroom 73 and the storage 74 are provided inside the main frame member 10 in an unexpanded state of the house 71, so that even when the house 1 is not expanded, the bathroom 73 and the storage 74 can be used as they are. Therefore, the bathroom 73 and the storage 74 can be used even in a state where the movable prefabricated container house 71 is non-expanded and being transported/moved. Accordingly, the movable prefabricated container house 71 can be effectively used even in a state where the movable prefabricated container house 71 is being transported/moved.

The present invention is not intended to be limited to the first and second embodiments, and various modifications may be made thereto.

For example, the interior spaces of the movable prefabricated container houses 1 and 71 can be modified, when necessary. Further, in the movable prefabricated container house 1 or 71, a solar electric generator may be disposed on a ceiling portion. With the electric generator electrically connected to the movable prefabricated container house 1 or 71, the electric generator is disposed on an exterior portion, so that a power supply for consumer-electronic appliances can be secured. Further, windows may be provided to the outer wall panels 37*a* to 37*h*. Thus, ventilation through the windows is made possible in the houses 1, 17. Up to eighty (80) percent of the wall may be made of glass or other transparent or clear materials subject to support and strength determined by engineering design. Further, the floorboards 31*a*, 31*b* and the ceiling boards 32*a*, 32*b* do not necessarily have rotation structures, but may have slidable structures.

For example, when the house 1 remains unexpanded (before expanding), the right floorboard 31*a* and the right ceiling board 32*a* may overlap each other so that the right ceiling board 32*a* is located outside the right floorboard 31*a*; and the left floorboard 31*b* and the left ceiling board 32*b* may overlap each other so that the left ceiling board 32*b* is located outside the left floorboard 31*b*. This configuration can give a good capability in waterproof against rain and the like to the movable prefabricated container house 1 when the movable prefabricated container house 1 is transported or expanded. In addition, the right ceiling board 32*a* and the left ceiling board 32*b* functioned as a ceiling/roof can be expanded prior to or regardless of the expansion of the right floorboard 31*a* and the left floorboard 31*b*. Therefore, with the above configuration, assemblers can expand/assemble the movable prefabricated container house 1 into a dwelling without letting themselves and the right floorboard 31*a* and the left floorboard 31*b* be exposed to the rain when it is raining after the expansion of the right ceiling board 32*a* and the left ceiling board 32*b*. Further, the movable prefabricated container house 1 can be used only with the expansion of the right ceiling board 32*a* and the left ceiling board 32*b* functioned as a ceiling/roof shutting out the rain or the sunlight when the movable prefabricated container house 1 is used without the expansion of the right floorboard 31*a* and the left floorboard 31*b*. Therefore, the above configuration can give a large repertoire of the usage of the movable prefabricated container house 1.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A prefabricated container house comprising:

a main body transportable/movable to an installation site; and all components of a house forming body configured to be housed within the main body, transported/moved to the installation site along with the main body, and drawn out on both sides of the main body at the installation site so as to be expanded/assembled, wherein the main body includes a container-shaped main frame member capable of being pulled by a trailer truck, the house forming body includes a plurality of dwelling forming members which can be housed in the main frame member, and which can be drawn out of the main frame member at the installation site and assembled into a house, the main frame member is formed into a box shape with a pair of upper and lower horizontal frames forming a floor and a ceiling, respectively, and with a pair of vertical frames each connecting the horizontal frames at the ends of the horizontal frames to form a wall, the dwelling forming members include a floorboard, a ceiling board, wall panels, a bath/toilet unit, and a kitchen unit, the main frame member houses a sub-frame member including:

a floor supporting frame supporting the floorboard which is drawn out of the main frame member and assembled at the installation site; and a ceiling supporting frame supporting the ceiling board which is drawn out of the main frame member and assembled at the installation site, the floorboard and the ceiling board are overlapped and housed between the pair of horizontal frames, some of the wall panels are overlapped with the corresponding one of the vertical frames and housed, and the rest of the wall panels are overlapped and housed at an intermediate position between the vertical frames.

2. The prefabricated container house according to claim 1, wherein the sub-frame member includes a plurality of reinforcing columns provided between the pair of horizontal frames so as to reinforce the frame member.

3. The prefabricated container house according to claim 1, wherein the floor supporting frame and the ceiling supporting frame are drawn outward from the horizontal frames.

4. The prefabricated container house according to claim 1, wherein two or more of the house bodies are stacked to form a multi-story dwelling.

5. A container house comprising:

a main frame member having a box shape, including a pair of vertical frames having a rectangular plate shape, upper and lower horizontal frames each having a rectangular plate shape connected to the pair of vertical frames, and an opening on at least one of sides of the main frame member;

a movable floorboard configured to horizontally extend from a lower portion of the main frame member outward of the main frame member;

a movable ceiling board configured to horizontally extend from an upper portion of the main frame member outward of the main frame member; and movable wall panels provided so as to be drawn out of one of the vertical frames between the movable floorboard and the movable ceiling board, with the movable floorboard and the movable ceiling board extended horizontally, wherein the floorboard and the ceiling board are overlapped and housed between the pair of horizontal frames, some of the wall panels are overlapped with the corresponding one of the vertical frames and housed, and the rest of the wall panels are overlapped and housed at an intermediate position between the vertical frames.

6. The container house according to claim 5, wherein the movable floorboard is supported on the lower portion of the main frame member pivotally between a vertical position and a horizontal position about a horizontal axis, and the movable floorboard functions as a cover closing the opening of the main frame member in the horizontal position.

7. The container house according to claim 5, wherein the movable ceiling board is supported on the upper portion of the main frame member pivotally about a horizontal axis.

8. The container house according to claim 5, wherein the movable wall panels include outer wall panels each supported on an end of the movable wall panels pivotally about a vertical axis.

9. The container house according to claim 5, further comprising a floor supporting frame protrudable under the movable floorboard from a lower portion of the main frame member so as to support the movable floorboard extended horizontally.

10. The container house according to claim 5, further comprising a ceiling supporting frame protrudable over the movable ceiling board from an upper portion of the main frame member so as to support the movable ceiling board extended horizontally.

11. The container house according to claim 5, further comprising a bed unit supported on a lower portion of the main frame member pivotally about a horizontal axis.

12. The container house according to claim 5, wherein the movable wall panels are provided slidably on the movable floorboard.

13. The container house according to claim 5, wherein the movable ceiling board is supported on the upper portion of the main frame member pivotally between a vertical position and a horizontal position about a horizontal axis, and the movable ceiling board functions as a cover closing the opening of the main frame member in the horizontal position.

14. A container house, comprising:

a main frame member having a box shape, including a pair of vertical frames having a rectangular plate shape, upper and lower horizontal frames each having a rectangular plate shape connected to the pair of vertical frames, and an opening on at least one of sides of the main frame member;

a movable floorboard configured to horizontally extend from a lower portion of the main frame member outward of the main frame member, the movable floorboard being supported on the lower portion of the main frame member pivotally between a vertical position and a horizontal position about a horizontal axis, and the movable floorboard functioning as a cover closing the opening of the main frame member in the horizontal position;

a movable ceiling board configured to horizontally extend from an upper portion of the main frame member outward of the main frame member, the movable ceiling board being supported on the upper portion of the main frame member pivotally about a horizontal axis;

movable wall panels provided so as to be drawn out of one of the vertical frames between the movable floorboard and the movable ceiling board, with the movable floorboard and the movable ceiling board extended horizontally, the movable wall panels being provided slidably on the movable floorboard, the movable wall panels including outer wall panels each supported on an end of the movable wall panels pivotally about a vertical axis;

a floor supporting frame protrudable under the movable floorboard from a lower portion of the main frame member so as to support the movable floorboard extended horizontally; and a ceiling supporting frame protrudable over the movable ceiling board from an upper portion of the main frame member so as to support the movable ceiling board extended horizontally, wherein the floorboard and the ceiling board are overlapped and housed between the pair of horizontal frames, some of the wall panels are overlapped with the corresponding one of the vertical frames and housed, and the rest of the wall panels are overlapped and housed at an intermediate position between the vertical frames.

* * * * *